US011155326B2

(12) United States Patent
Jing

(10) Patent No.: US 11,155,326 B2
(45) Date of Patent: Oct. 26, 2021

(54) BIO-INSPIRED UNDERWATER ROBOT

(71) Applicant: THE HONG KONG POLYTECHNIC UNIVERSITY, Hong Kong (CN)

(72) Inventor: Xingjian Jing, Hong Kong (CN)

(73) Assignee: THE HONG KONG POLYTECHNIC UNIVERSITY, Hong Kong (CN)

( * ) Notice: Subject to any disclaimer, the term of this patent is extended or adjusted under 35 U.S.C. 154(b) by 0 days.

(21) Appl. No.: 16/822,381

(22) Filed: Mar. 18, 2020

(65) Prior Publication Data

US 2020/0307750 A1 Oct. 1, 2020

Related U.S. Application Data

(60) Provisional application No. 62/825,918, filed on Mar. 29, 2019.

(51) Int. Cl.

| | |
|---|---|
| ***B63G 8/08*** | (2006.01) |
| ***B63G 8/00*** | (2006.01) |
| ***B63H 1/36*** | (2006.01) |
| ***B63H 23/06*** | (2006.01) |

(52) U.S. Cl.

CPC ..... *B63G 8/08* (2013.01); *B63G 8/001* (2013.01); *B63H 1/36* (2013.01); *B63H 23/06* (2013.01); *B63G 2008/002* (2013.01)

(58) Field of Classification Search

CPC . B63G 8/00; B63G 8/001; B63G 8/08; B63G 8/16; B63G 8/22; B63H 1/00; B63H 1/36; B63H 23/00; B63H 23/06; B63H 11/00; B25J 9/00; B25J 9/06; B25J 9/065; B25J 9/08; B25J 9/12

USPC ..... 114/331, 337; 606/1; 700/245

See application file for complete search history.

(56) References Cited

U.S. PATENT DOCUMENTS

| | | | | |
|---|---|---|---|---|
| 5,355,743 | A * | 10/1994 | Tesar | B25J 9/08 475/149 |
| 5,820,623 | A * | 10/1998 | Ng | A61B 34/70 606/1 |
| 6,922,610 | B2 * | 7/2005 | Okamoto | B25J 9/06 700/245 |
| 8,317,555 | B2 * | 11/2012 | Jacobsen | B63C 11/34 114/312 |
| 8,494,676 | B2 * | 7/2013 | Ayers | B25J 9/1085 700/245 |
| 9,051,036 | B2 * | 6/2015 | Kim | B63G 8/16 |

(Continued)

*Primary Examiner* — Lars A Olson

(74) *Attorney, Agent, or Firm* — Spruson & Ferguson (Hong Kong) Limited

(57) ABSTRACT

A bionic underwater robot for achieving a variety of motions is disclosed. The bionic underwater robot includes a head and one or more tail structures. Each of the one or more tail structures includes one or more joint structures. Each of the one or more joint structures includes a connection plate, and a modular assembly, comprising an upper servo motor, a lower servo motor, and a bevel gear mechanism, is motorized for performing various movement motions of the joint structure. The bevel gear mechanism is integrally formed by an intermediate bevel gear, a first bevel gear, and a second bevel gear. The upper servo motor drives the first bevel gear from a first side of the modular assembly, while the lower servo motor drives the second bevel gear from a second side.

20 Claims, 24 Drawing Sheets

(56) References Cited

U.S. PATENT DOCUMENTS

| | | | | |
|---|---|---|---|---|
| 9,126,332 | B2 * | 9/2015 | Caron L'Ecuyer | B25J 9/06 |
| 9,597,796 | B2 * | 3/2017 | Rollinson | B25J 9/08 |
| 10,751,872 | B2 * | 8/2020 | Pettersen | B25J 9/065 |
| 2009/0248202 | A1 * | 10/2009 | Osuka | B25J 9/065 700/245 |

* cited by examiner

BIO-INSPIRED UNDERWATER ROBOT

CROSS-REFERENCE TO RELATED APPLICATIONS

This application claims the benefit of U.S. Provisional Patent Application No. 62/825,918, filed on Mar. 29, 2019, which is incorporated by reference herein in its entirety.

FIELD OF THE INVENTION

The present disclosure generally relates to the field of bionic underwater robot, and particularly relates to a bio-inspired underwater robot for achieving a variety of motions with better stability, mobility, agility, and loading capability in a diverse water flow environment.

BACKGROUND OF THE INVENTION

In the field of underwater vehicles, bio-inspired underwater robots are the ongoing research trend and development. The underwater device can be used in applications such as underwater inspection, surveillance, maintenance, repair, and marine life observation. However, the conventional underwater devices are generally bulky and noisy. The acoustic noise of the rotating propellers may disturb the marine environment and adversely affect the effectiveness of the inspection and observation activities.

At present, there are a few bionic underwater robots or drones proposed. Such underwater robots may mimic the natural movements of a variety of marine life, for example, cuttlefish, tuna, dolphin, snake, turtle, shark, manta ray, etc. However, in view of the size and structure, the existing bio-inspired underwater robots cannot maintain a stable and smooth movement above or under the water when there is a variable flow of water. The ability to carrying monitoring equipment or other bulky devices is also in doubt. Furthermore, the underwater robots may only be propelled by a tin or tail of a simple structure. There is usually only one movement mode, and the movement direction is limited to be within a small angle or in accordance with a particular manner.

Accordingly, there is a need in the art to have an improved bio-inspired underwater robot for achieving omnidirectional movement under the sea with stable movement in a variable water flow environment. Furthermore, other desirable features and characteristics will become apparent from the subsequent detailed description and the appended claims, taken in conjunction with the accompanying drawings and this background of the disclosure.

SUMMARY OF THE INVENTION

Provided herein is a bionic underwater robot. It is an objective of the present disclosure to provide a bionic underwater robot that can achieve a variety of motions with better stability, mobility, agility, and loading capability in a diverse water flow environment.

In accordance with certain embodiments of the present disclosure, a bionic robot for underwater use is provided. The bionic robot comprises a head and one or more tail structures. Each of the one or more tail structures comprises one or more joint structures. Each of the one or more joint structures comprises a connection plate, and a modular assembly motorized for performing various movement motions of the joint structure. The modular assembly comprises an upper servo motor, a lower servo motor, and a bevel gear mechanism.

In accordance with a further aspect of the present disclosure, the bevel gear mechanism is integrally formed by an intermediate bevel gear, a first bevel gear, and a second bevel gear. The upper servo motor drives the first bevel gear from a first side of the modular assembly. The lower servo motor drives the second bevel gear from a second side of the modular assembly.

In accordance with a further aspect of the present disclosure, the connection plate is fixedly attached to or screwed to the intermediate bevel gear for achieving a yaw motion or a pitch motion of the joint structure.

In accordance with a further aspect of the present disclosure, the upper servo motor drives an upper motor gear coupled to a first reduction gear via a first middle gear, and the lower servo motor drives a lower motor gear coupled to a second reduction gear via a second middle gear. The first reduction gear and the first bevel gear are fixed, and the second reduction gear and the second bevel gear are fixed.

Preferably, the first reduction gear has a larger number of teeth than the first middle gear, and the second reduction gear has a larger number of teeth than the second middle gear.

In accordance with a further aspect of the present disclosure, each tail structure comprises a fin structure fixed to an end plate sealed at a longitudinal distal end of the tail structure. The fin structure is a bionic fishtail with an emarginate caudal fin shape.

In accordance with a further aspect of the present disclosure, the joint structure is mechanically sealed within a silicone tube and a skeleton, thereby the modular assembly is sealed inside the joint structure. The silicone tube is tightly clamped to the skeleton using a clamp and silicone glue to prevent water seepage.

In accordance with a further aspect of the present disclosure, the head comprises one or more tail drive assemblies for controlling movement of the one or more tail structure. The tail drive assembly comprises a head servo motor, a motor pinion, a spur gear, a motor shaft, and a rotary shaft, wherein the motor shaft is fixed to the motor pinion for driving the spur gear and the rotary shaft.

Preferably, the motor pinion has a smaller number of teeth than the spur gear for reducing the rotational speed of the rotary shaft.

Preferably, the rotary shaft is connected to the tail structure for driving the tail structure with a good sealing effect from an external water environment.

In accordance with a further aspect of the present disclosure, the head comprises three sealed connectors for connecting to an underwater acoustic transceiver or other accessory devices, wherein the underwater acoustic transceiver is configured to communicate based on an underwater acoustic network (UAN).

In accordance with a further aspect of the present disclosure, the head comprises a plurality of infrared sensors.

In accordance with a further aspect of the present disclosure, the head comprises one or more pressure sensors.

In accordance with a further aspect of the present disclosure, the modular assembly is cable driven, or hydraulic driven.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Other aspects and advantages of the present invention are disclosed as illustrated by the embodiments hereinafter.

BRIEF DESCRIPTION OF THE DRAWINGS

The appended drawings contain figures to further illustrate and clarify the above and other aspects, advantages, and features of the present disclosure. It will be appreciated that these drawings depict only certain embodiments of the present disclosure and are not intended to limit its scope. It will also be appreciated that these drawings are illustrated for simplicity and clarity and have not necessarily been depicted to scale. The present disclosure will now be described and explained with additional specificity and detail through the use of the accompanying drawings in which.

Skilled artisans will appreciate that elements in the figures are illustrated for simplicity and clarity and have not necessarily been depicted to scale.

DETAILED DESCRIPTION OF THE INVENTION

The present disclosure generally relates to the structure of a bionic underwater robot. More specifically, but without limitation, the present disclosure provides a bio-inspired underwater robot for achieving a variety of motions with better stability, mobility, agility, and loading capability in a diverse water flow environment.

The following detailed description is merely exemplary in nature and is not intended to limit the disclosure or its application and/or uses. It should be appreciated that a vast number of variations exist. The detailed description will enable those of ordinary skilled in the art to implement an exemplary embodiment of the present disclosure without undue experimentation, and it is understood that various changes or modifications may be made in the function and structure described in the exemplary embodiment without departing from the scope of the present disclosure as set forth in the appended claims.

The benefits, advantages, solutions to problems, and any element(s) that may cause any benefit, advantage, or solution to occur or become more pronounced are not to be construed as a critical, required, or essential features or elements of any or all of the claims. The invention is defined solely by the appended claims including any amendments made during the pendency of this application and all equivalents of those claims as issued.

Terms such as "upper", "lower", "inner", "outer", "front", "rear", "top", "bottom", and any variations thereof are used for ease of description to explain the positioning of an element, or the positioning of one element relative to another element, and are not intended to be limiting to a specific orientation or position. Terms such as "first", "second", and the like are used herein to describe various elements, components, regions, sections, etc., and are not intended to be limiting.

When introducing elements of the present disclosure or the preferred embodiments thereof, the articles "a", "an", and "the" are not intended to denote a limitation of quantity, but rather to denote the presence of at least one of the items being referred to, unless otherwise indicated or clearly contradicted by context. Further, the terms "comprise", "comprising", "including", and "having" are intended to be inclusive and mean that there may be additional elements other than the listed elements.

Figure 1:
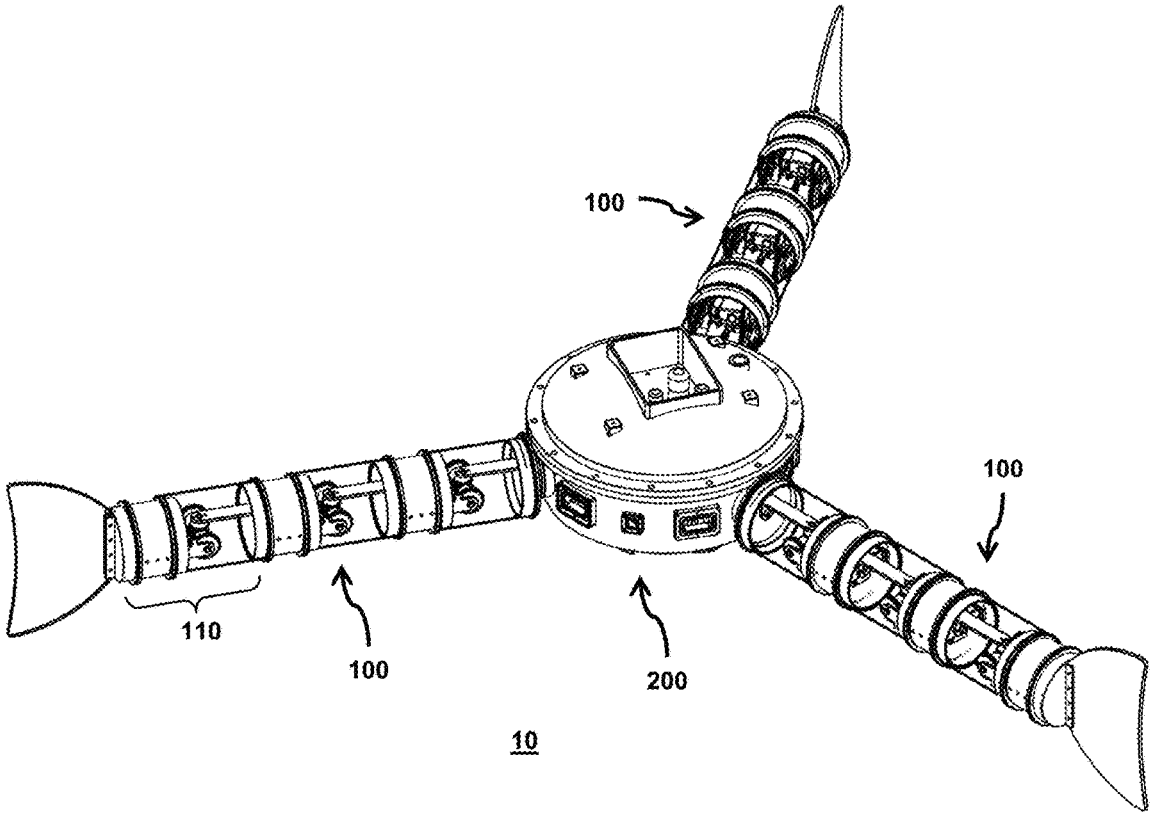
FIG. 1 shows a perspective view of a bionic robot in accordance with certain embodiments of the present disclosure.
Figure 2:
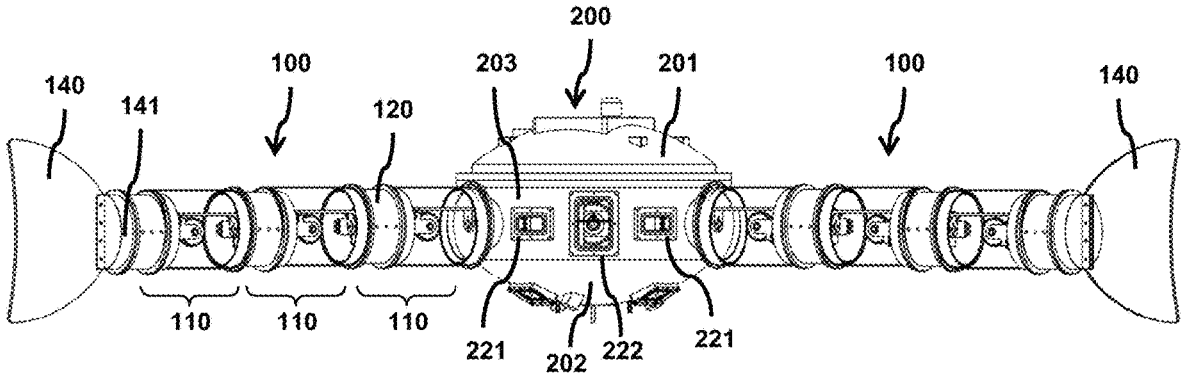
FIG. 2 shows a front view of the bionic robot of FIG. 1.
Figure 3:
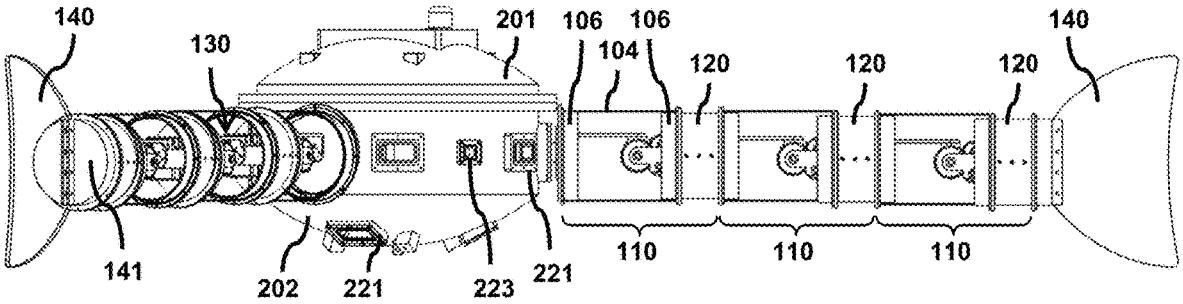
FIG. 3 shows a side view of the bionic robot of FIG. 1.

A bionic robot 10 assembled with three tail structures 100 is shown in FIG. 1. The bionic robot 10 comprises a head 200 and one or more tail structures 100. The head 200 is preferably in the shape of an oblate spheroid, but it is apparent that the head 200 may also be in the shape of a cube, cuboid, prism, circular cone, circular truncated cone, pyramid, multi-sided pyramid, cylinder, elliptical cylinder, or any combinations thereof without departing from the scope and spirit of the present disclosure. In FIGS. 1-7 and 16A-21, a bionic robot 10 having three tail structures 100 is used in the drawings, and it is appreciated that such tail structure 100 configuration as shown in FIGS. 1-7 and 16A-21 is provided solely for the purpose of illustrating a preferred embodiment of the present invention and not for the purpose of limiting the same, and that the bionic robot 10 may take other suitable configurations. In certain embodiments, the bionic robot 10 may have one, two, three, four, five, or more tail structures 100, wherein each tail structure 100 may have one, two, three, four, or more joint structures 110. The configuration on the number of tail structures 100 and the number of joint structures 110 is based on the required underwater task and the respective underwater condition. Each tail structure 100 of the bionic robot 10 may have a different number of joint structures 110. When using in an open sea or rough water conditions, the number of tail structures 100 can be increased to provide better stability, mobility, agility, and loading capability.

As shown in FIGS. 2-5, the head 200 includes a generally vertical circular wall 203, concentrically mounted to or otherwise welded to a generally half dome-shaped top housing 201 and a generally half dome-shaped bottom housing 202. On the circular wall 203, there is provided a plurality of infrared sensors 221, one or more pressure sensors 223, and one or more sealed covers 222. On the bottom housing, there is also provided a plurality of infrared sensors 221. In the illustrated bionic robot 10, there are six infrared sensors 221 on the circular wall 203, and three infrared sensors 221 on the bottom housing 202. The infrared sensors 221 are mounted on a printed circuit board configured to receive infrared signals for communication or distance measurement purposes. Preferably, the infrared sensors 221 are positioned symmetrically around the circular wall 203 and the bottom housing 202 to acquire accurate information of the underwater conditions. The pressure sensor 223 is configured to detect the submerged depth of the bionic robot 10 based on the water pressure. The data communication between the bionic robot 10 and a sub-surface device (not shown in the drawings) may be based on an UAN, and the head 200 may be connected to an underwater acoustic transceiver for acoustically communicating to and from the sub-surface device. The UAN communication may include at least a command signal, a data signal, or any combinations thereof. Alternatively, the data communication may be performed through a wired network or other wireless signal networks.

Figure 4:
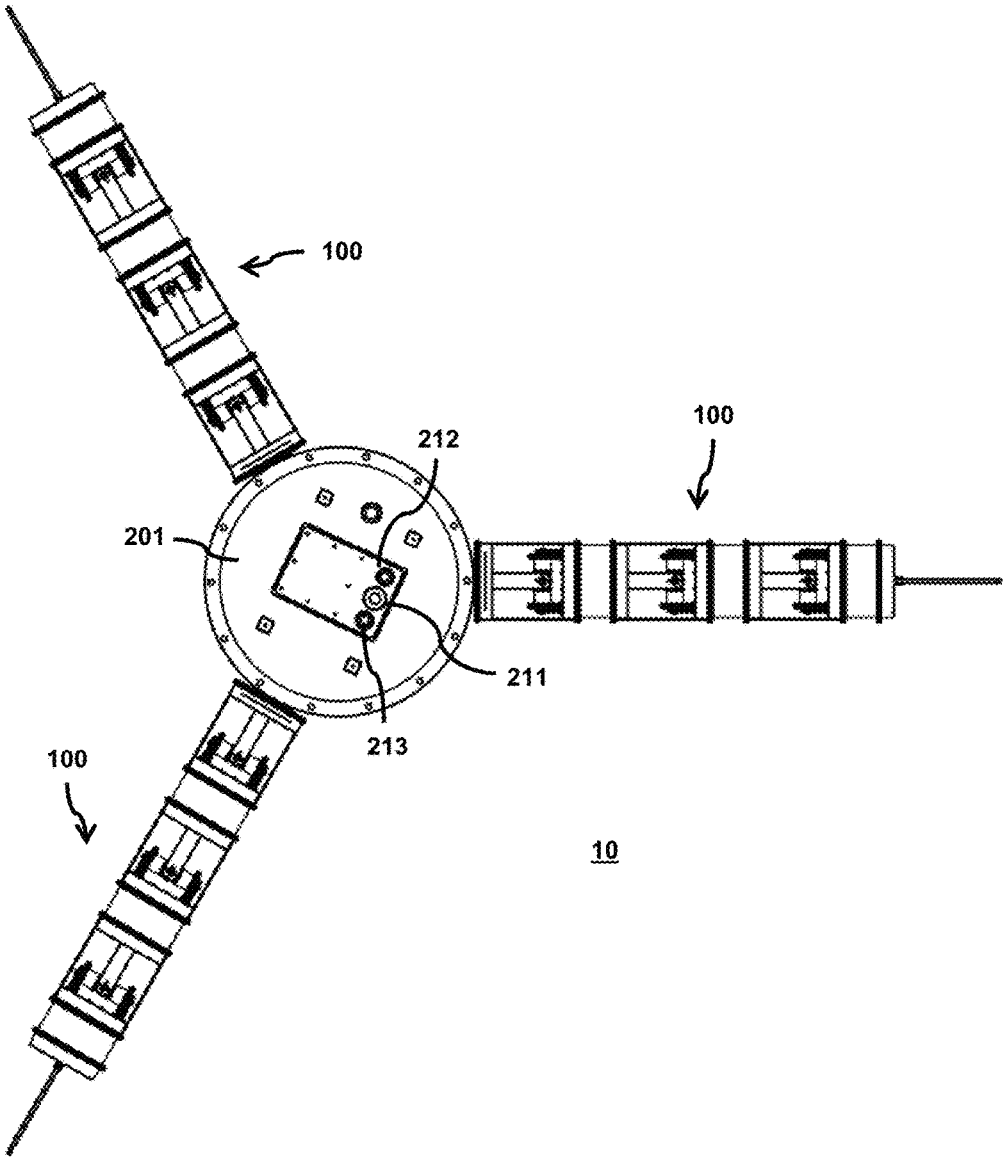
FIG. 4 shows a top view of the bionic robot of FIG. 1.
Figure 5:
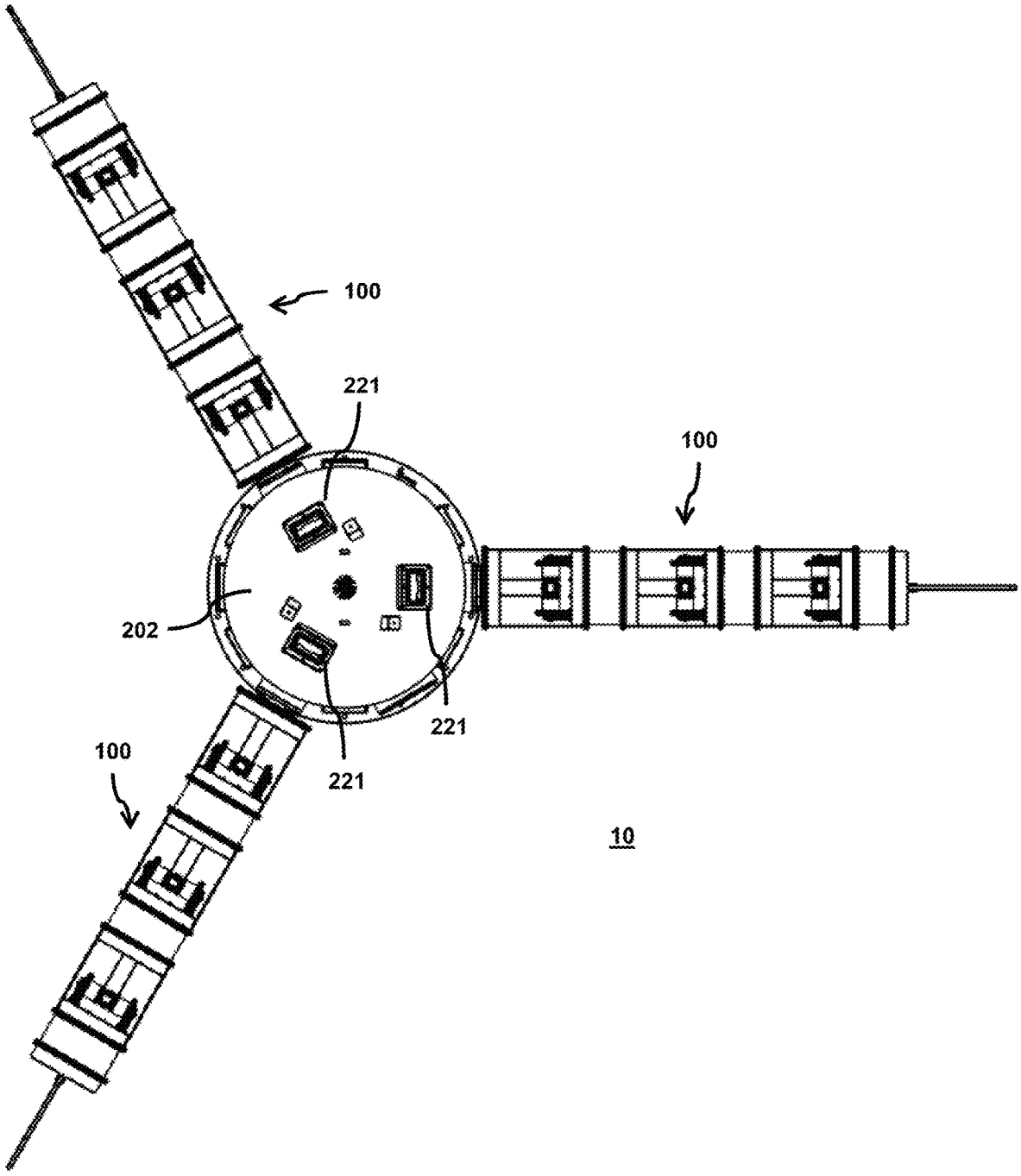
FIG. 5 shows a bottom view of the bionic robot of FIG. 1.

The top housing 201, as shown in FIG. 4, includes three sealed connectors 211-213, which may be connected to the underwater acoustic transceiver. In other embodiments, one or more of the three sealed connectors 211-213 may be connected to other accessory devices. For example, the head 200 may be connected to measurement equipment, video recorder, robotic gripper, or other accessory devices. The accessory device can rest on the top housing 201 to achieve superior loading capability. In certain embodiments, counterweights (not shown in drawings) are added inside the head 200 to ensure that the bionic robot 10 has the ability to dive with sufficient stability. Electrical power can be supplied to the bionic robot 10, which can be supplied from a battery placed inside the head 200 or otherwise on the sub-surface connected with a power cable. Interconnecting wirings and cables, battery, printed circuit boards, and other electronic parts may be used and may be positioned inside the head 200. For convenience and simplicity, the battery and the respective electronic parts have not been shown in the figures.

Each tail structure 100 is an elongated cylindrical tube comprising one or more joint structures 110 and a fin structure 140. The fin structure 140 is a bionic fishtail with an emarginate caudal fin shape. In other embodiments, the fin structure 140 may have a truncated or rounded caudal fin shape. The fin structure 140 is fixed to an end plate 141 sealed at a longitudinal distal end of each tail structure 100.

The joint structure 110 is mechanically sealed within a silicone tube 104 (or other rubber tubes) and a skeleton 120 to achieve waterproofing and the flexibility for performing various movement motions. The silicone tube 104 is tightly clamped to the skeleton 120 using a clamp 106 and silicone glue to prevent water seepage. A modular assembly 130 is sealed inside the joint structure 110, which is motorized for the realization of the various movement motions of the joint structure 110. Throughout the specification, the silicone tubes 104 are illustrated as transparent cylinders for simplicity, and it is appreciated that the silicone tubes 104 may not necessarily be transparent and may not have the shape of a cylinder. Instead, the silicone tubes 104 may be elastically connected between the skeletons 120 such that the joint structures 110 have the flexibility and freedom to turn for performing various movement motions. In certain embodiments, the joint structure 110 may also be designed in a flexural way and the skeleton 120 may be removed or replaced by other components made of flexible material.

Figure 6:
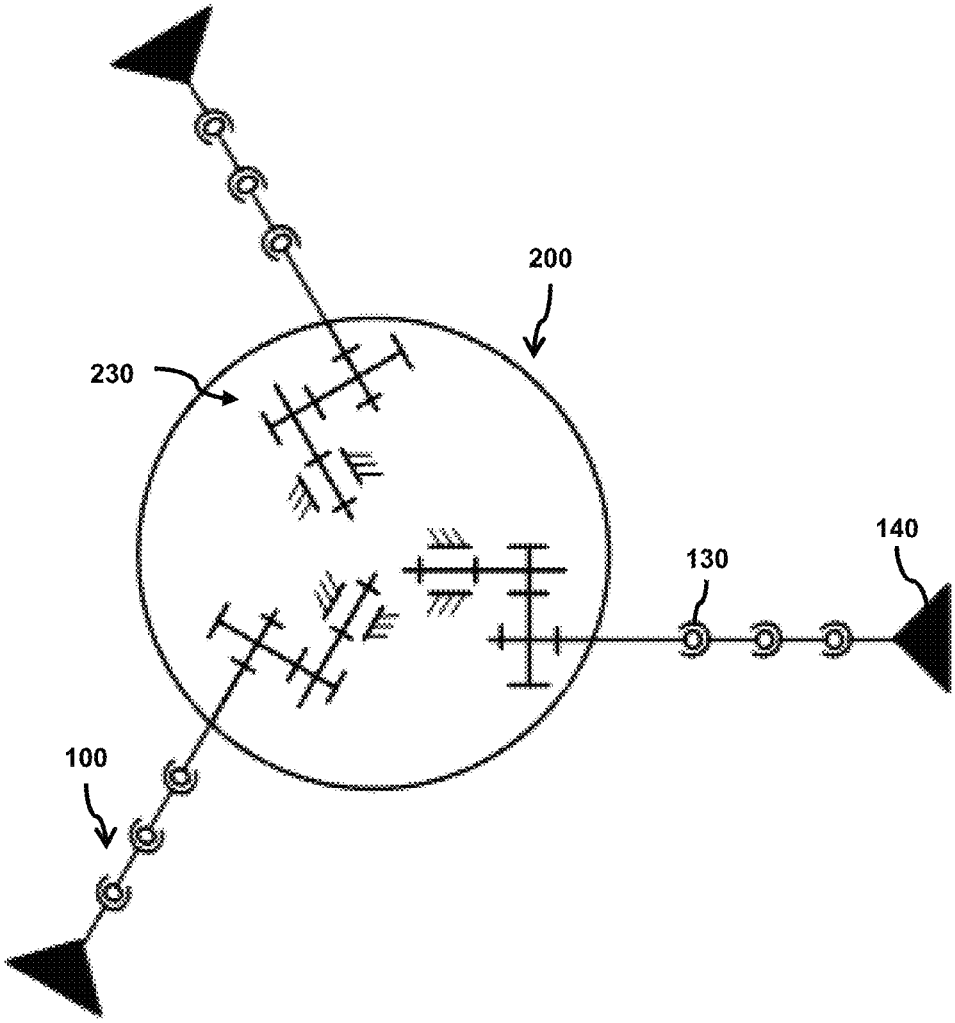
FIG. 6 shows a simplified schematic diagram of the bionic robot in accordance with certain embodiments of the present disclosure.

FIG. 6 shows a simplified schematic diagram of the bionic robot 10 having three tail structures 100 along the circumference of the circular wall 203 of the head 200. Although the three tail structures 100 are spaced evenly with 120 degrees apart, it is obvious that they may be located in other positions and may or may not be spaced evenly from one another, depending on the application and the number of tail structures 100 in the bionic robot 10. Inside the head 200, there is a separated tail drive assembly 230 in associated with each tail structure 100 for controlling a one-directional movement of the entire tail structure 100. Inside each tail structure 100, there are one or more modular assemblies 130 for controlling the movement of each joint. The farthest modular assembly 130 of each tail structure 100 can control the movement of the fin structure 140.

Figure 7:
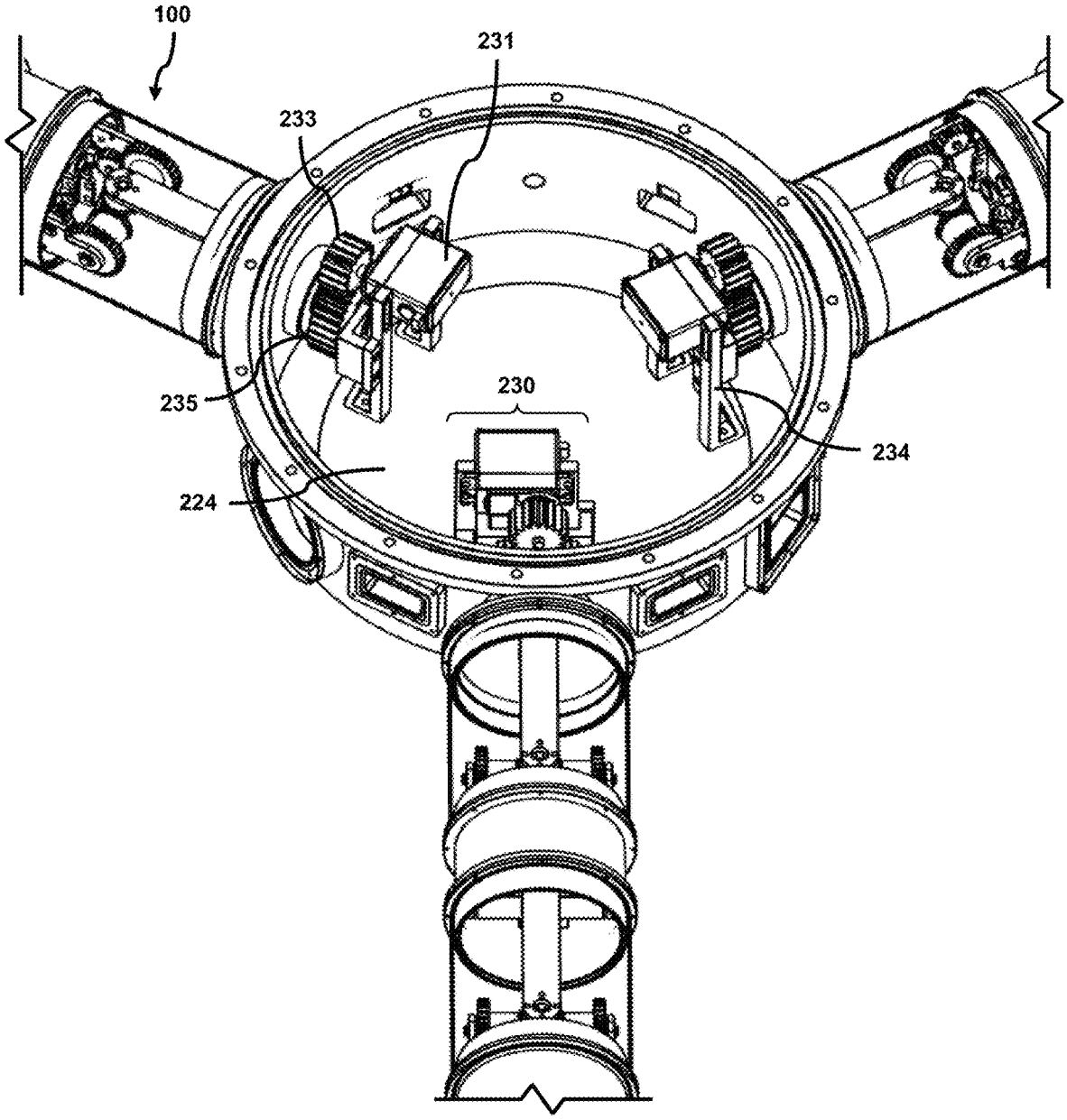
FIG. 7 shows an internal view of the head of the bionic robot of FIG. 1.
Figure 8:
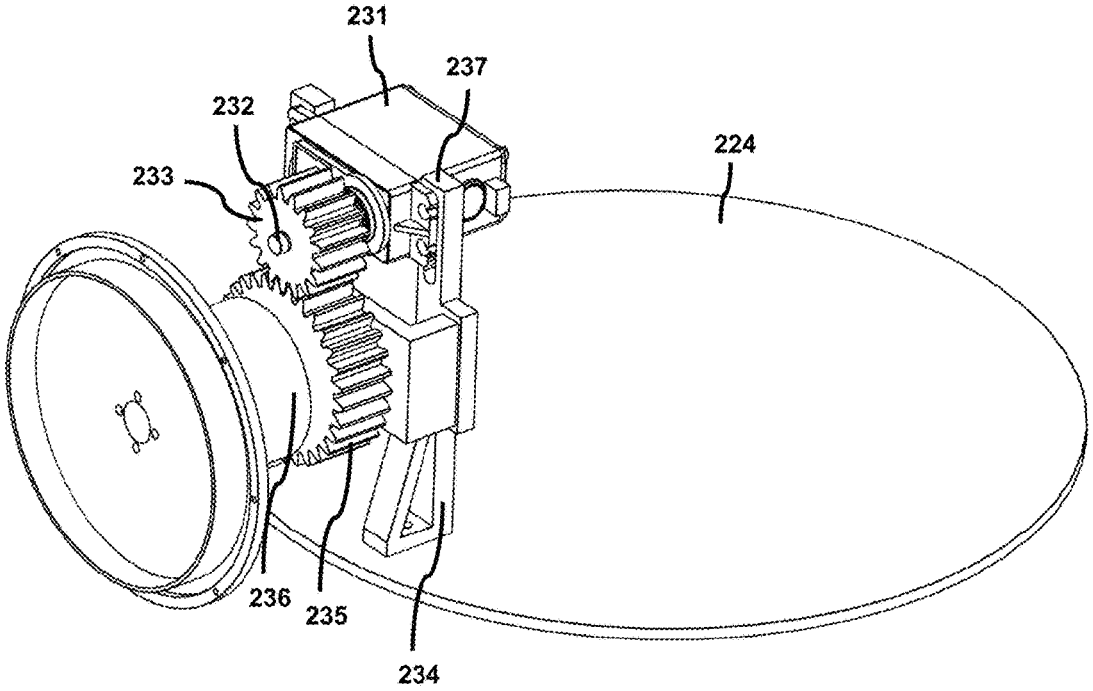
FIG. 8 shows a perspective view of a tail drive assembly in accordance with certain embodiments of the present disclosure.
Figure 9:
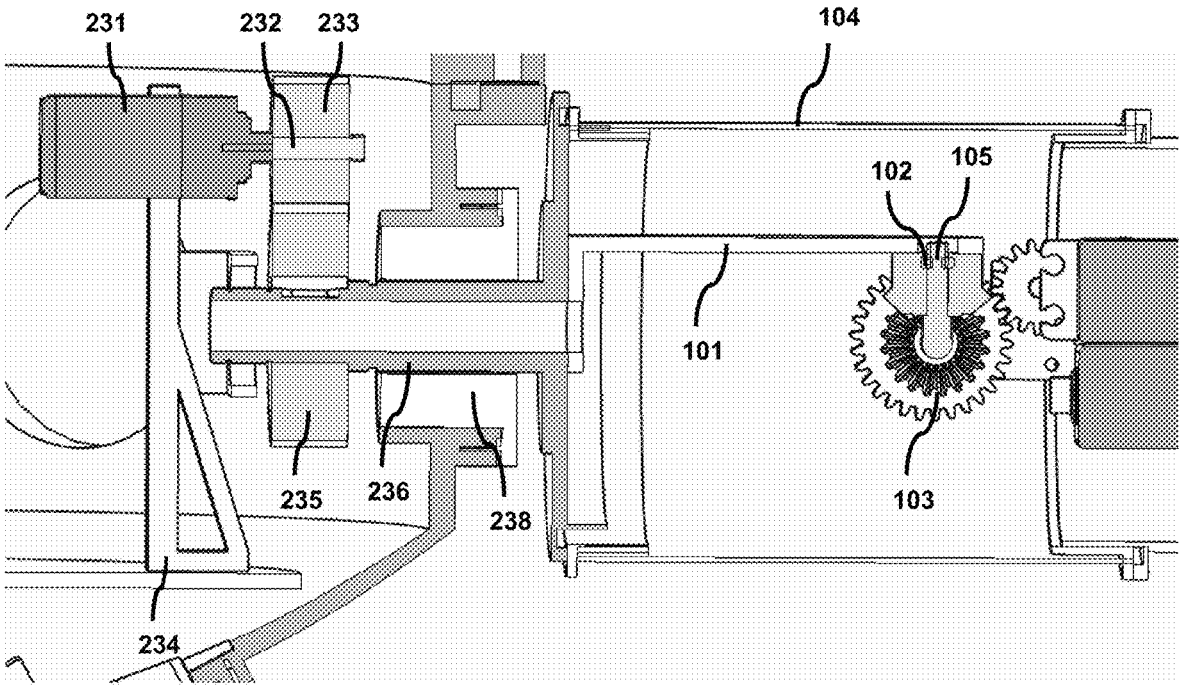
FIG. 9 shows a cross-sectional view of the tail drive assembly connecting to a tail structure in accordance with certain embodiments of the present disclosure.

In more detail, the structure of the tail drive assembly 230 is depicted in. FIGS. 7-9. The tail drive assembly 230 is placed on a bottom plate 224 inside the head 200. The bottom plate 224 may have a circular shape with a diameter equal to or less than the diameter of the circular wall 203, and is firmly mounted inside the head 200 by screws or other fasteners. For each tail structure 100, there is a tail drive assembly 230 placed at the corresponding position adjacent to the tail structure 100 inside the head 200. Therefore, if there are two tail structures 100, the head 200 may only include two tail drive assemblies 230. A mechanical support 234 is mounted on the bottom plate 224 to secure the tail drive assembly 230 thereto. The tail drive assembly 230 comprises a head servo motor 231, a motor pinion 233, a spur gear 235, a motor shaft 232, and a rotary shaft 236. The head servo motor 231 is fixed on a motor mount 237 on the mechanical support 234, and drives a motor shaft 232 to rotate. The motor shaft 232 is fixed to the motor pinion 233 for driving the spur gear 235 and the rotary shaft 236. The spur gear 235 is engaged with the motor pinion 233 and rotates concentrically with the rotary shaft 236. The motor pinion 233 has a smaller number of teeth than the spur gear 235 for reducing the rotational speed of the rotary shaft 236. The rotary shaft 236 is a hollowed shaft connected to the tail structure 100 for driving the rotational movement of the entire tail structure 100 with a sealing 238 for providing a good sealing effect from the external water environment.

Figure 10A:
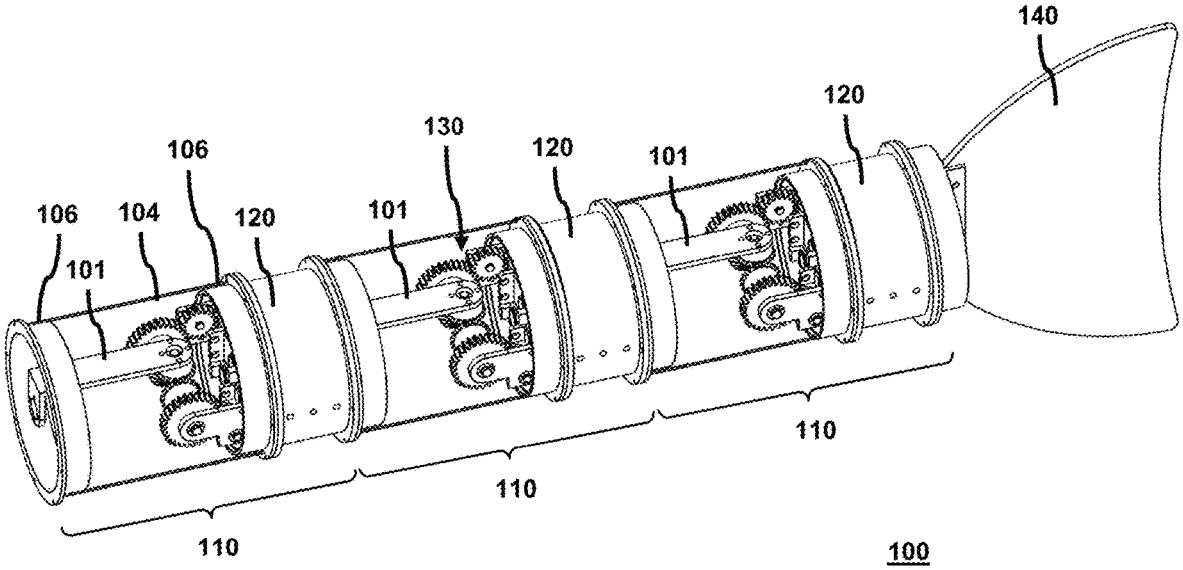
FIG. 10A shows a perspective view of a tail structure in a first configuration in accordance with certain embodiments of the present disclosure.
Figure 10B:
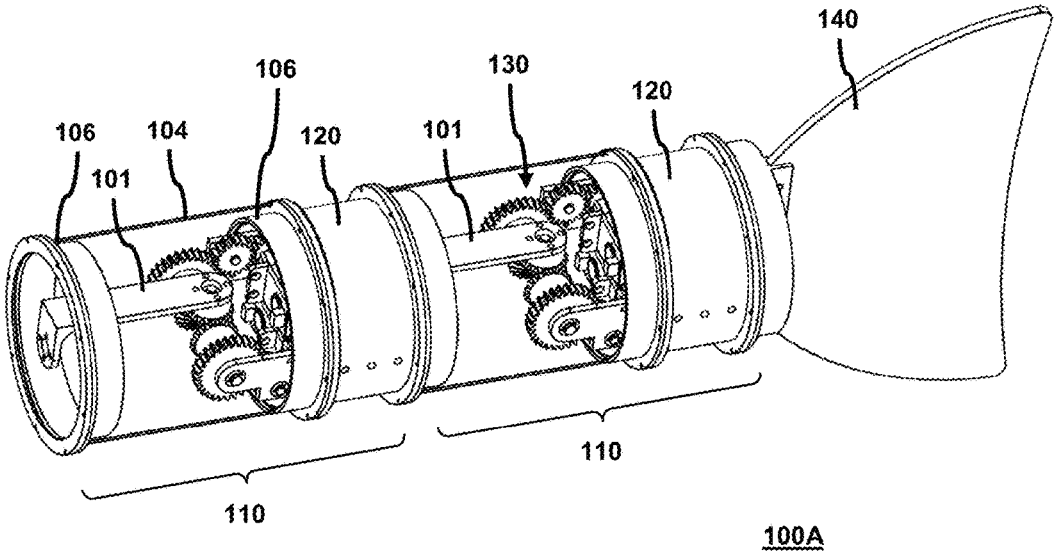
FIG. 10B shows a perspective view of a tail structure in a second configuration in accordance with certain embodiments of the present disclosure.
Figure 11:
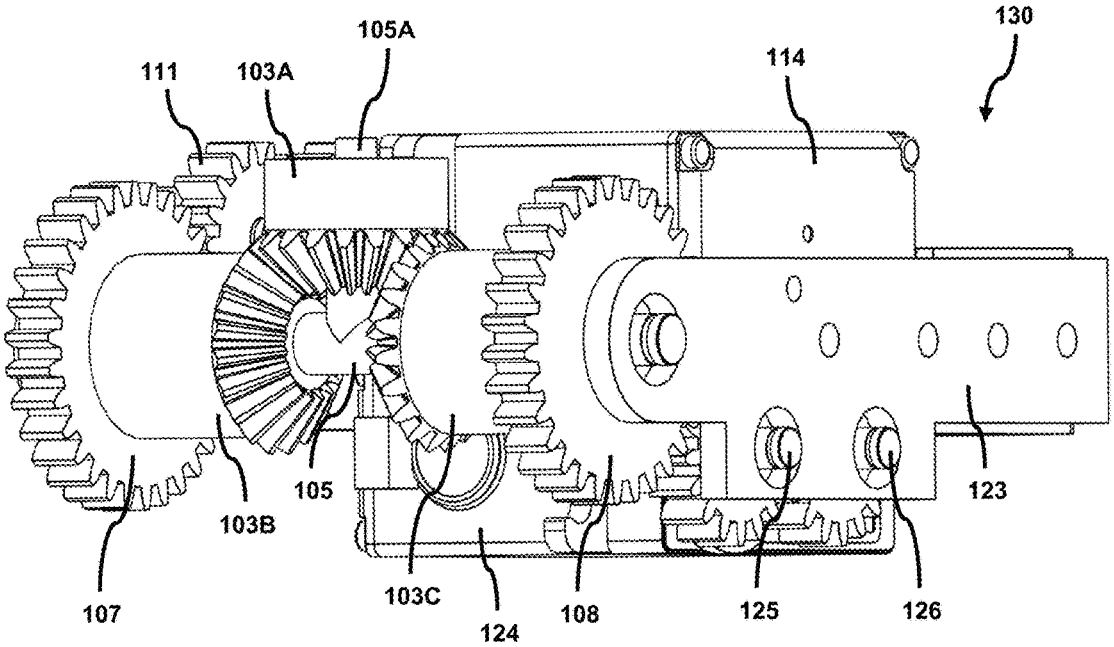
FIG. 11 shows a front left side view of a modular assembly in accordance with certain embodiments of the present disclosure.
Figure 12:
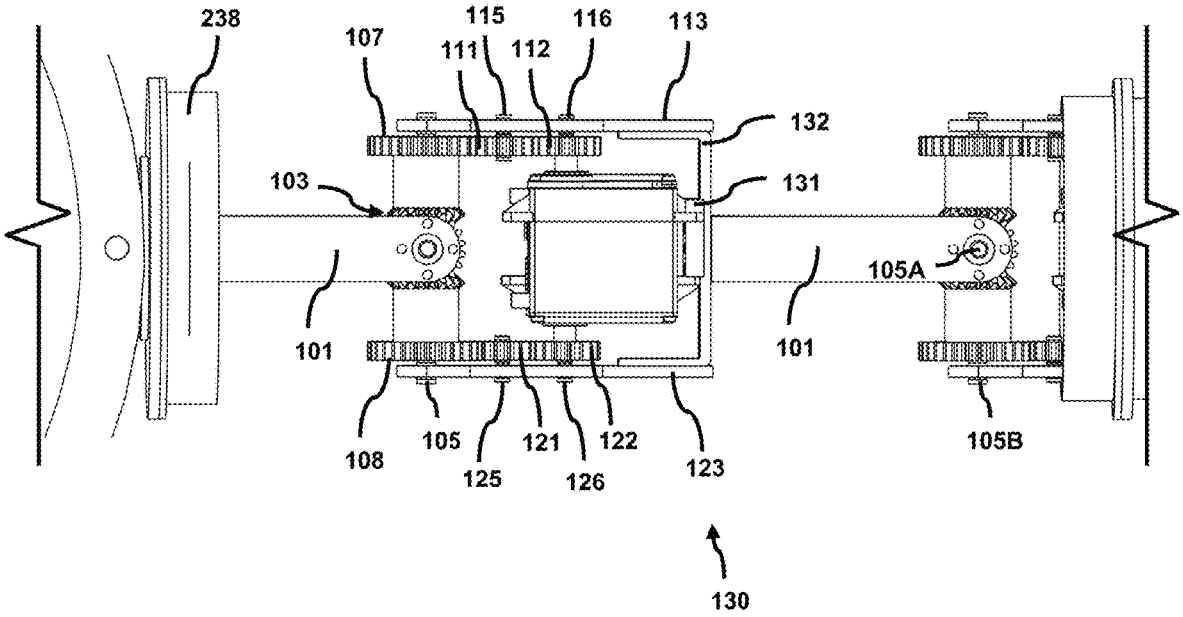
FIG. 12 shows a top view of the modular assembly in a tail structure in accordance with certain embodiments of the present disclosure.
Figure 13:
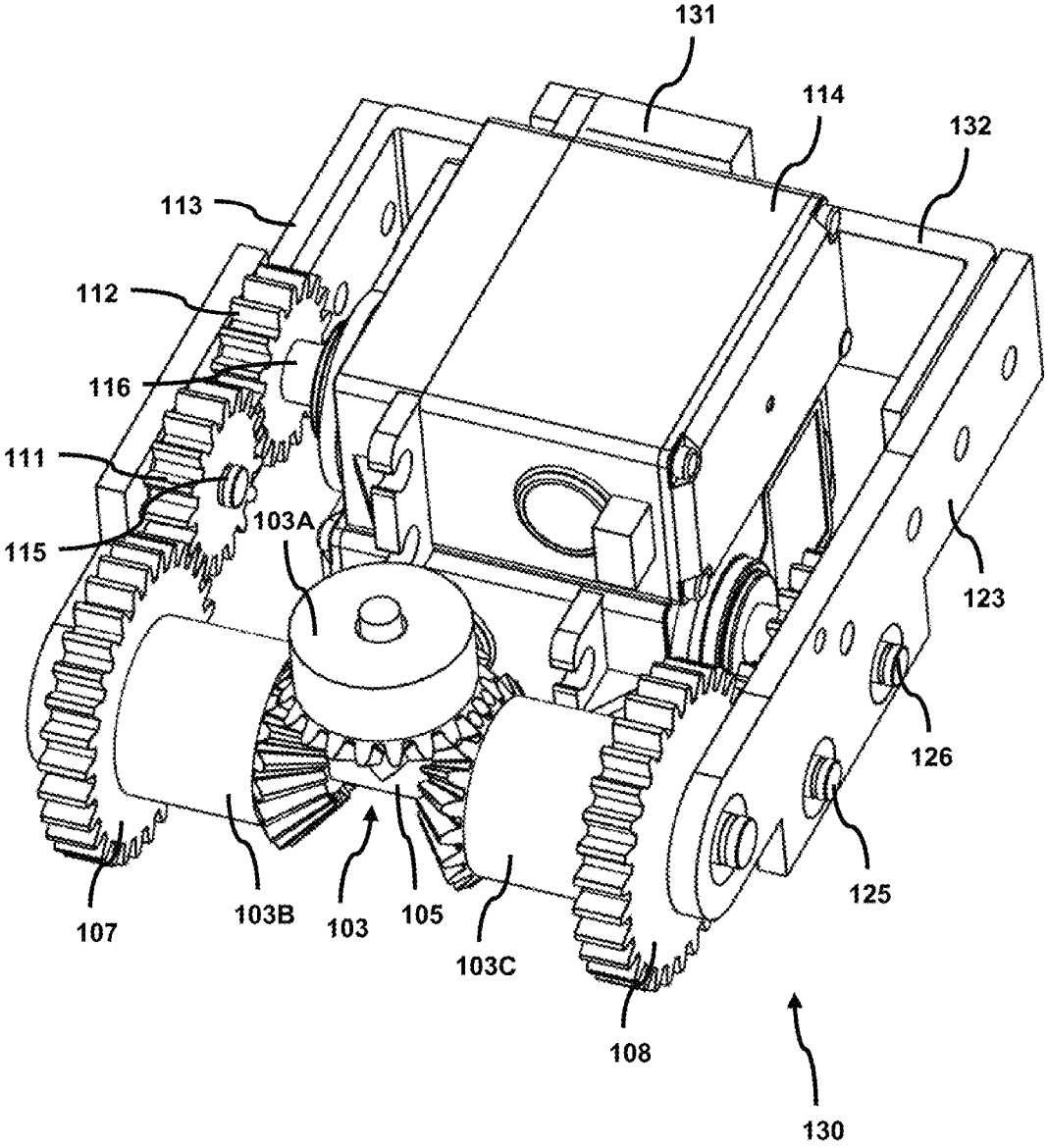
FIG. 13 shows a perspective view of the modular assembly of FIG. 11.
Figure 14:
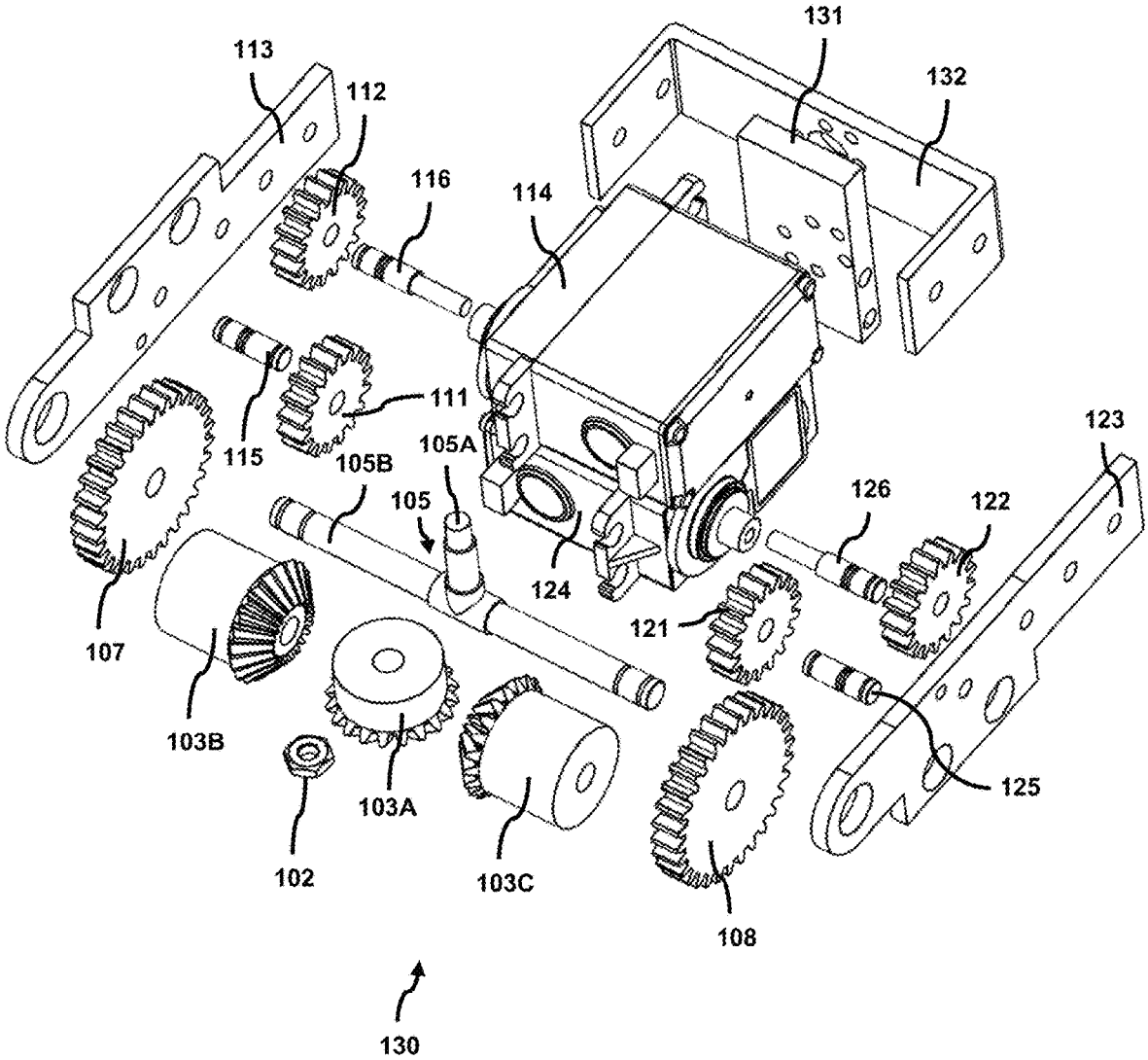
FIG. 14 shows an exploded view of the modular assembly of FIG. 11.

The tail structure 100 may have a different number of joint structures 110. The typical case is shown in FIG. 10A with three joint structures 110. An alternative case is shown in FIG. 10B with two joint structures 110, and denoted as a short tail structure 100A. The short tail structure 100A can also be connected to the head 200 for specific applications. The joint structure 110 comprises a modular assembly 130 and a connection plate 101.

FIG. 11-14 shows an exemplary structure of the modular assembly 130 in accordance with certain embodiments of the present disclosure. The modular assembly 130 is a gear driven modular ball pair that can achieve a variety of motions, such as a yaw motion and a pitch motion. It is appreciated that the modular assembly 130 may otherwise be configured to be driven by cable or hydraulic without departing from the scope and spirit of the present disclosure. The modular assembly 130 comprises a bevel gear mechanism 103, an upper servo motor 114, a lower servo motor 124, and a plurality of gears. The bevel gear mechanism 103 is integrally formed by three bevel gears coupled together. The modular assembly 130 is configured to enable the joint structure 110 to perform both longitudinal rotation and lateral rotation, with one-directional movement or two-directional movement. In the case of cable driven modular assembly 130, the bevel gear mechanism 103 is driven by a plurality of pulleys and pulley cables for transferring the driving force to the connection plate 101. In yet another alternative, the modular assembly 130 may be driven by one or more hydraulic powered structures.

The upper servo motor 114 drives an upper motor shaft 116 and the upper motor gear 112 to rotate. The upper motor gear 112 is engaged to a first middle gear 111, and further engaged to a first reduction gear 107. The gears are aligned along a first side of the modular assembly 130 and driven by the upper servo motor 114 to transmit power to the bevel gear mechanism 103. The upper motor gear 112 and the first middle gear 111 may have the same number of teeth, while the first reduction gear 107 has a larger number of teeth for reducing the rotational speed of the first reduction gear 107. The upper motor gear 112 and the first middle gear 111 are respectively mounted on the upper motor shaft 116 and the middle shaft 115, which are both fixed on a first side plate 113.

Similarly, the lower servo motor 124 drives a lower motor shaft 126 and the lower motor gear 122 to rotate. The lower motor gear 122 is engaged to a second middle gear 121, and further engaged to a second reduction gear 108. The gears are aligned along a second side of the modular assembly 130 symmetrical to the first side and driven by the lower servo motor 124 to transmit power to the bevel gear mechanism 103. The lower motor gear 122 and the second middle gear 121 may have the same number of teeth, while the second reduction gear 108 has a larger number of teeth for reducing the rotational speed of the second reduction gear 108. The lower motor gear 122 and the second middle gear 121 are respectively mounted on the lower motor shaft 126 and the middle shaft 125, which are both fixed on a second side plate 123.

The bevel gear mechanism 103 includes an intermediate bevel gear 103A, a first bevel gear 103B, and a second bevel gear 103C. As carried on a T-shaped shaft 105, the intermediate bevel gear 103A is affixed to the vertical element 105A of the T-shaped shaft 105, while the first bevel gear 103B and the second bevel gear 103C are both affixed to the horizontal element 105B of the T-shaped shaft 105 such that they are 90 degrees apart from the intermediate bevel gear 103A with a change of direction. Preferably, the three bevel gears in the bevel gear mechanism 103 are a matched set of bevel gears with the same number of teeth.

The first bevel gear 103B and the first reduction gear 107 are fixed by screw such that the upper motor gear 112 can be rotated to drive the first bevel gear 103B. The second bevel gear 103C and the second reduction gear 108 are also fixed by screw such that the lower motor gear 122 can be rotated to drive the second bevel gear 103C. The connection plate 101 is fixedly attached to or screwed to the intermediate bevel gear 103A.

On the rear side of the modular assembly 130, a motor mounting plate 131 is vertically arranged for fixedly securing the upper servo motor 114 and the lower servo motor 124 thereto. A U-shaped rear plate 132 may be used to connect the first side plate 113 and the second side plate 123 as a protective shield for the two servo motors 114, 115. The connection plate 101 from the subsequent joint structure 110 is fixedly mounted to the rear plate 132 such that the two joint structures 110 are connected. For the joint structure 110 at the distal end of the tail structure 100, the rear plate 132 is fixedly mounted to an end plate 141 and the fin structure 140.

Figure 15A:
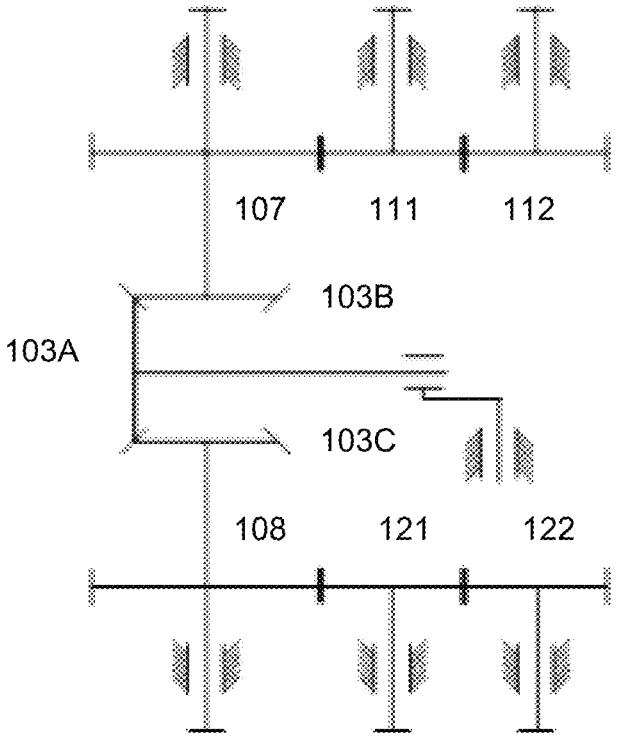
FIG. 15A shows a gear schematic of the modular assembly of FIG. 11.

The gear schematic of the modular assembly 130 is depicted in FIG. 15A. The gear transmission on the first side of the modular assembly 130 is configured to drive the first bevel gear 103B by rotating the upper motor gear 112 via the first middle gear 111 and the first reduction gear 107. Similarly, the gear transmission on the second side of the modular assembly 130 is configured to drive the second bevel gear 103C by rotating the lower motor gear 122 via the second middle gear 121 and the second reduction gear 108. Both the first bevel gear 103B and the second bevel gear 103C are engaged to the intermediate bevel gear 103A.

Figure 15B:
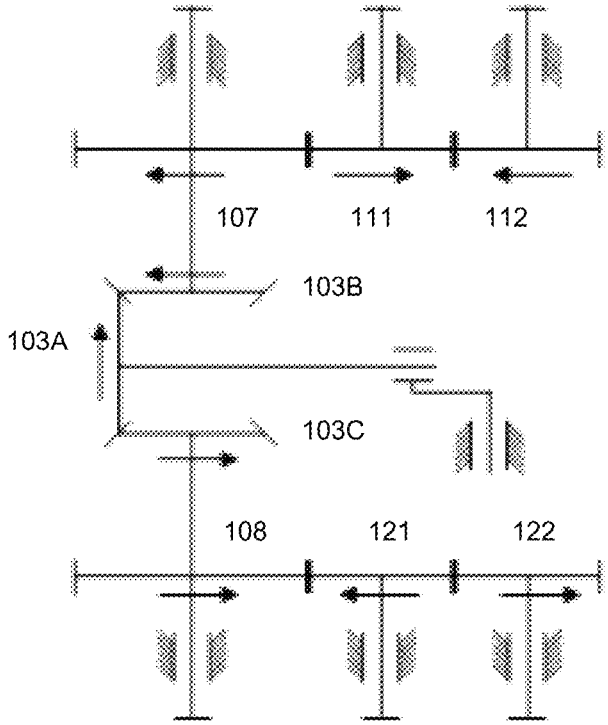
FIG. 15B shows a gear schematic of the modular assembly of FIG. 11 during a yaw motion.

Now referring to the gear schematic in FIG. 15B, when the upper motor gear 112 and the lower motor gear 122 are rotated in the opposite direction, the first bevel gear 103B and the second bevel gear 103C are also rotated in the opposite direction. The connection plate 101 fixedly attached to the intermediate bevel gear 103A will do a yaw motion of the joint structure 110. With the use of two servo motors 114, 115, the joint structure 110 can perform a one-directional movement or a two-directional movement, and the degree of the yaw motion can be precisely controlled.

Figure 15C:
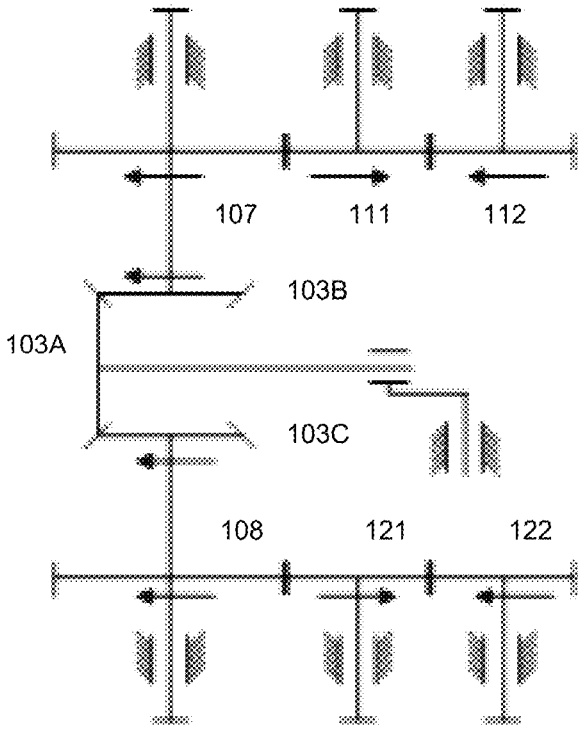
FIG. 15C shows a gear schematic of the modular assembly of FIG. 11 during a pitch motion.

Now referring to the gear schematic in FIG. 15C, when the upper motor gear 112 and the lower motor gear 122 are rotated in the same direction, the first bevel gear 103B and the second bevel gear 103C are also rotated in the opposite direction. The connection plate 101 fixedly attached to the intermediate bevel gear 103A will do a pitch motion of the joint structure 110. With the use of two servo motors 114, 115, the joint structure 110 can perform a one-directional movement or a two-directional movement, and the degree of the pitch motion can be precisely controlled.

Figure 16A:
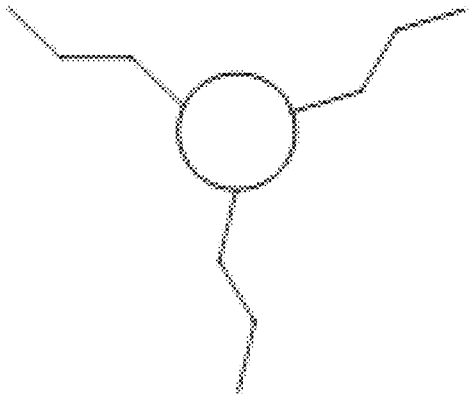
FIG. 16A shows a simplified conceptual drawing of the bionic robot in a first configuration.
Figure 16B:
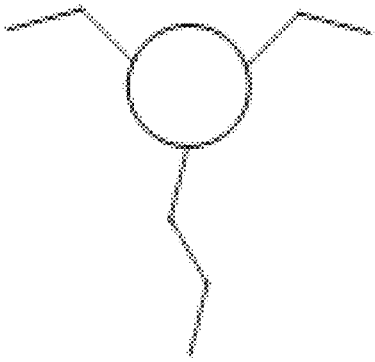
FIG. 16B shows a simplified conceptual drawing of the bionic robot in a second configuration.
Figure 16C:
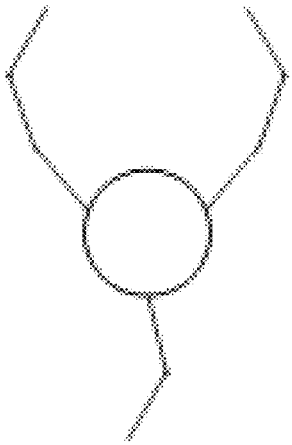
FIG. 16C shows a simplified conceptual drawing of the bionic robot in a third configuration.

FIGS. 16A-16C show the simplified conceptual drawings of the bionic robot 10 arranged in three different configurations. In the conceptual drawings, a short line represents a joint structure 110 with a modular assembly 130 provided therein. FIG. 16A shows a bionic robot 10 with three tail structures 100 having three joint structures 110 each. FIG. 16B shows a bionic robot 10 with a tail structure 100 having three joint structures 110, and two short tail structures 100A. FIG. 16C shows a bionic robot 10 with two tail structures 100 having three joint structures 110, and a short tail structure 100A. As the underwater environment may be different case by case, the number of the joint structures 110 varies for simulating the movement of different aquatic life, which can optimize the bionic robot 10 based on the required underwater task and the respective underwater condition.

In particular, the bionic robot 10 is based on coordinated control of the three tail structures 100 for realizing different swimming movement modes. There is no propeller or rotating blades to drive the bionic robot 10 forward, and so the movement may generate less noise with higher efficiency. In the following exemplary embodiments, a bionic robot 10 having three tail structures 100, each with three joint structures 110, is used as an example. Those various motions described below are programmed in the motor driver, and the operator can control the bionic robot 10 to perform such motion by sending a control command.

Figure 17:
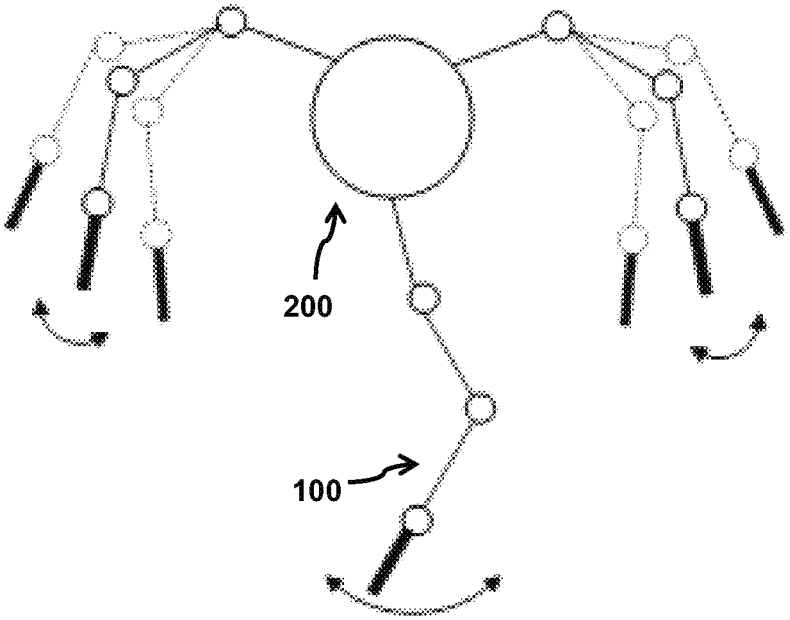
FIG. 17 shows a simplified conceptual drawing of the bionic robot of FIG. 16A in a forward motion.

FIG. 17 shows a conceptual drawing of the bionic robot 10 in a forward motion. The three tail structures 100 mimic the fishtail of a fish in nature and generate forward thrust to propel the bionic robot 10 by swinging the fin structure 140. With more joint structures 110, each tail structure 100 has a wider angle of oscillation to achieve higher efficiency and a larger propelling force.

Figure 18:
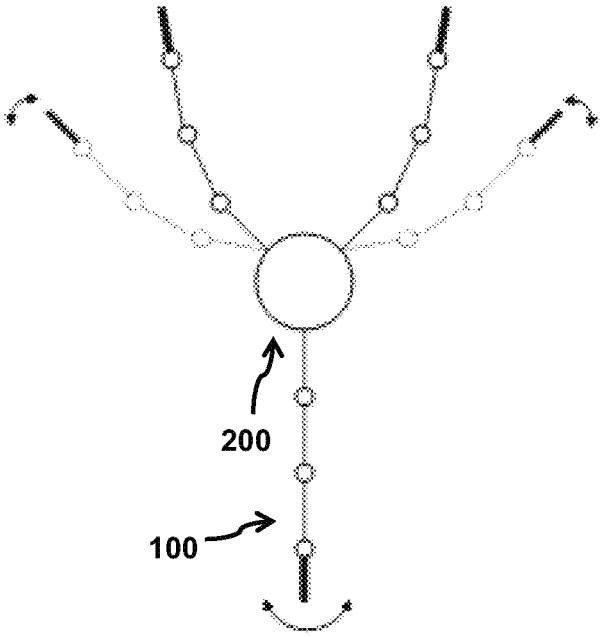
FIG. 18 shows a simplified conceptual drawing of the bionic robot of FIG. 16A in a 2-tail forward motion.

FIG. 18 shows a conceptual drawing of the bionic robot 10 in a 2-tail forward motion. Two of the tail structures 100 are arranged to swing on the front side, while the third tail structure 100 is positioned at the back in a generally stable manner, thereby a forward directional thrust is generated to propel the bionic robot 10 in the forward direction.

Figure 19:
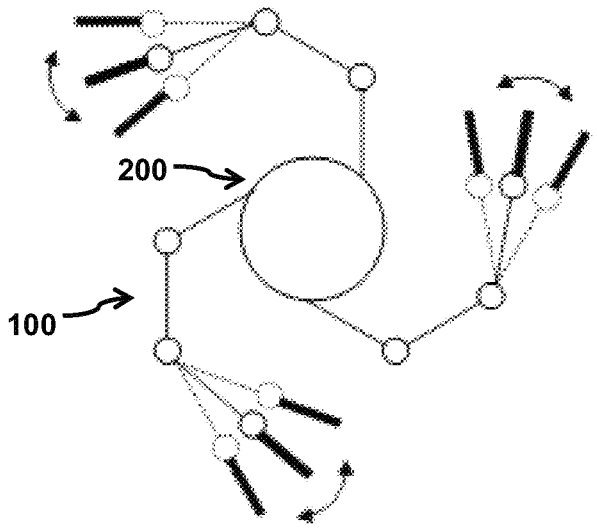
FIG. 19 shows a simplified conceptual drawing of the bionic robot of FIG. 16A in an in-situ rotation with zero turning radius motion.

FIG. 19 shows a conceptual drawing of the bionic robot 10 in an in-situ rotation with zero turning radius motion. The tail structures 100 are arranged in either a clockwise or an anticlockwise manner to generate rotational thrust.

Figure 20:
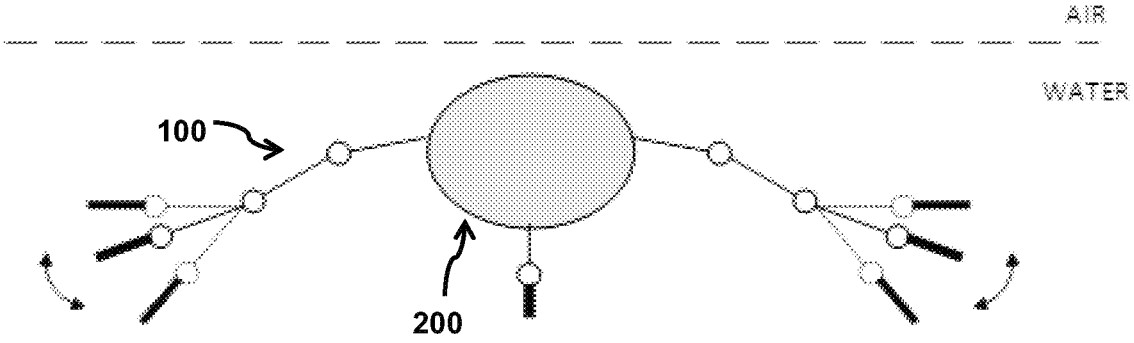
FIG. 20 shows a simplified conceptual drawing of the bionic robot of FIG. 16A in a floating upward motion.

FIG. 20 shows a conceptual drawing of the bionic robot 10 in floating upward motion. The tail structures 100 are arranged to point downwardly and oscillate to create an upward floating force, thereby the bionic robot 10 can be propelled up to the water surface.

Figure 21:
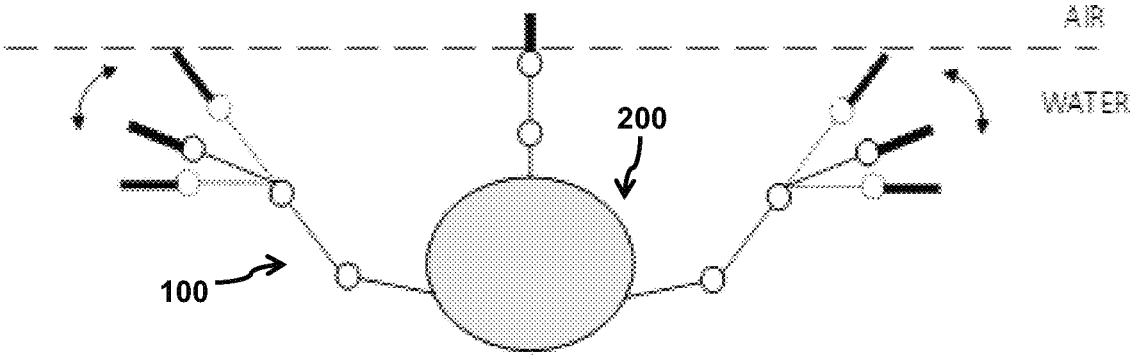
FIG. 21 shows a simplified conceptual drawing of the bionic robot of FIG. 16A in a diving downward motion.

FIG. 21 shows a conceptual drawing of the bionic robot 10 in a diving downward motion. The tail structures 100 are arranged to point upwardly and oscillate to create a downward diving force, thereby the bionic robot 10 can be propelled down into the water.

The bionic robot 10 may have one, two, three, four, five, or more tail structures 100, wherein each tail structure 100 may have one, two, three, four, or more joint structures 110. FIGS. 22-33 illustrate various possible configurations of the bionic robot 10 in accordance with certain aspects of the present disclosure. These figures are by no means restrictive of the possible configurations thereof.

Figure 22:
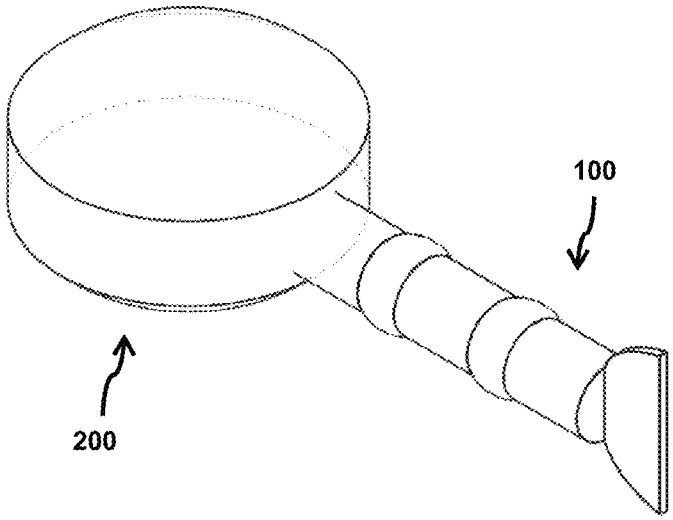
FIG. 22 is a simplified conceptual drawing of the bionic robot with one tail structure in accordance with certain embodiments of the present disclosure.
Figure 23:
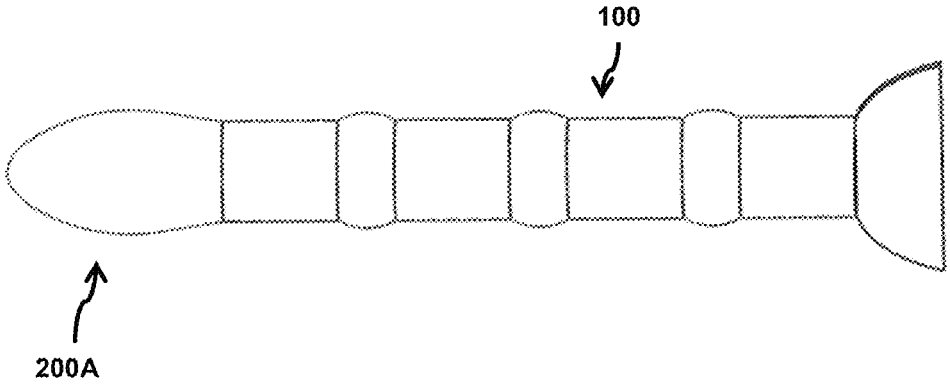
FIG. 23 is a simplified conceptual drawing of the bionic robot with one tail structure and a small head in accordance with certain embodiments of the present disclosure.

FIG. 22 is a conceptual drawing of the bionic robot 10 with one tail structure 100 connecting to the head 200. The single-tailed bionic robot 10 mimics the movement of a fish in the water, and the tail structure 100 is akin to the caudal fin of a fish. Due to the problem of the proportion and balancing between the head 200 and the tail structure 100, a smaller head 200A may be used, and the number of the joint structures 110 may further be increased to mimic the movement of a tuna or a snake, as shown in FIG. 23. However, with only one tail structure 100, the loading capability may be limited, and the bionic robot 10 may only carry fewer sensors.

Figure 24:
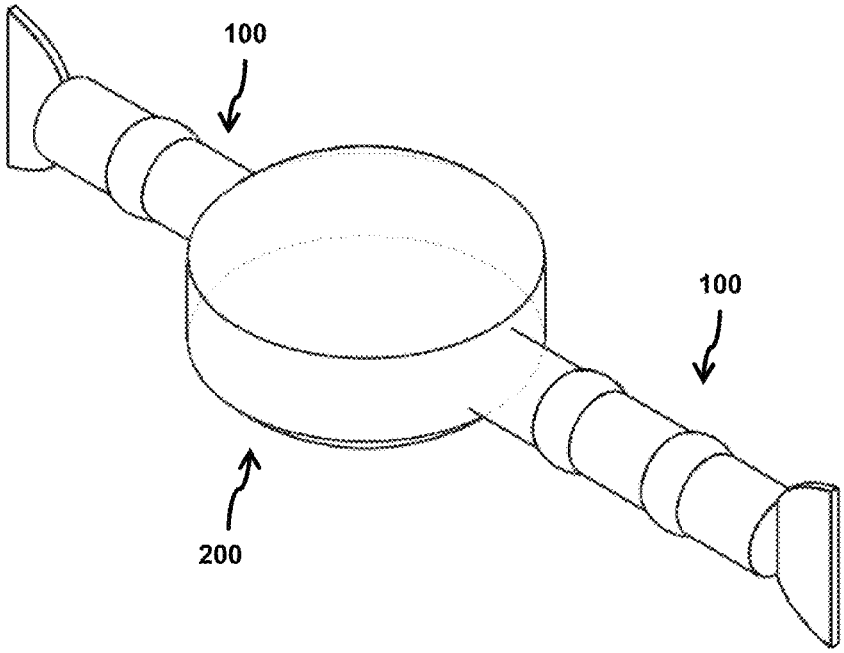
FIG. 24 is a simplified conceptual drawing of the bionic robot with two tail structures in accordance with certain embodiments of the present disclosure.
Figure 25:
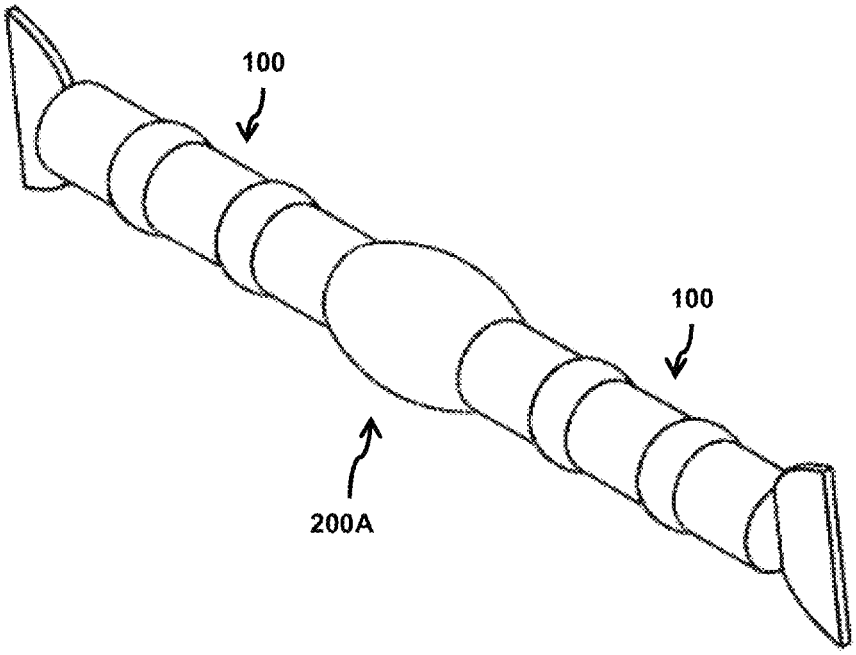
FIG. 25 is a simplified conceptual drawing of the bionic robot with two tail structures and a small head in accordance with certain embodiments of the present disclosure.
Figure 26:
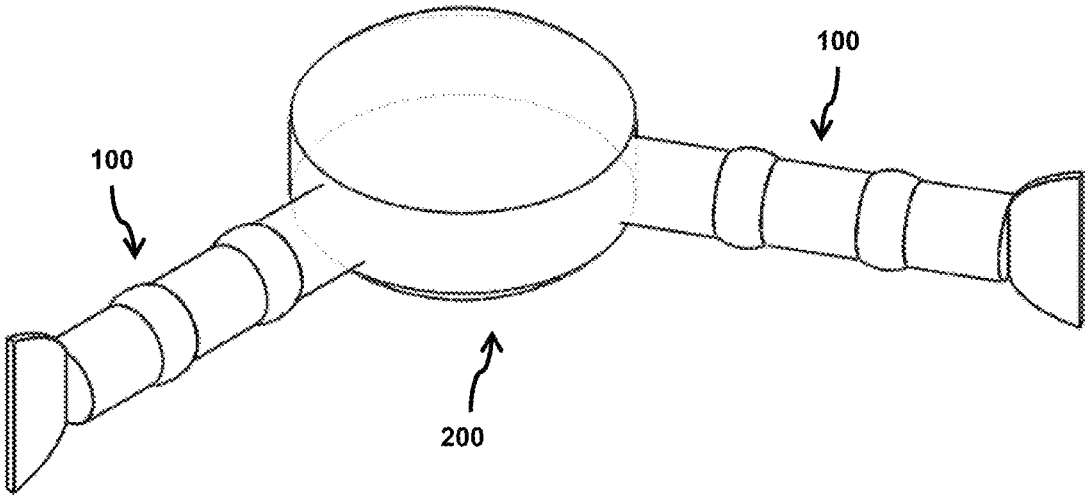
FIG. 26 is a simplified conceptual drawing of another bionic robot with two tail structure in accordance with certain embodiments of the present disclosure.

FIG. 24 is a conceptual drawing of the bionic robot 10 with two tail structures 100 connecting to the head 200. The two tail structures 100 are arranged on the same plane and may mimic the movement of a manta ray or a snake. In certain applications, when a smaller head 200A is used, the two tail structures 100 can also be arranged similarly to have a bionic robot 10 configured to mimic the movement of a snake, as shown in FIG. 25. The tail structures 100 may not be spaced evenly with 180 degrees apart. In the conceptual drawing of FIG. 26, the two tail structures 100 are spaced by an angle ranged from 60 to 165 degrees apart, or spaced by 120 degrees apart. This is particularly useful if the bionic robot 10 is required to carry heavy objects and many sensors, as this tail structure 100 arrangement can ensure better balance and stronger power for propelling the bionic robot 10 forward.

Figure 27:
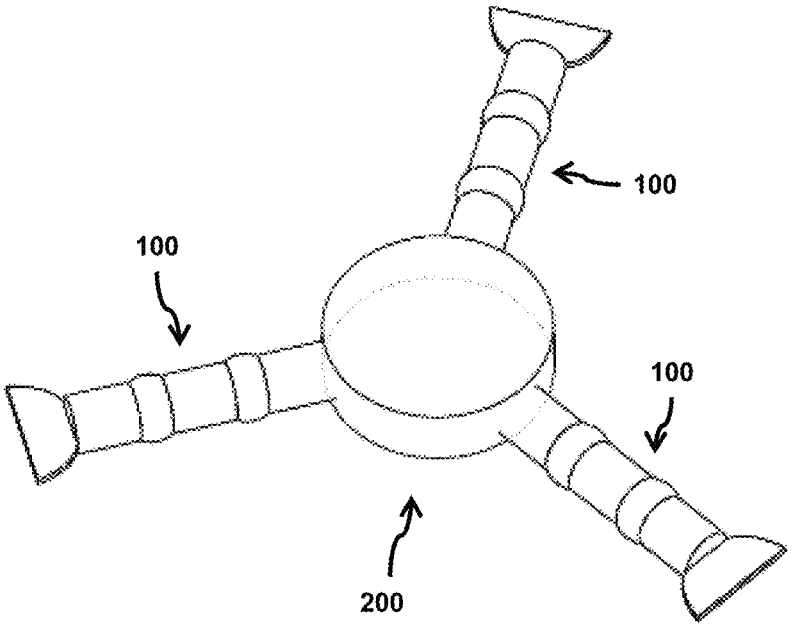
FIG. 27 is a simplified conceptual drawing of the bionic robot with three tail structures in accordance with certain embodiments of the present disclosure.
Figure 28:
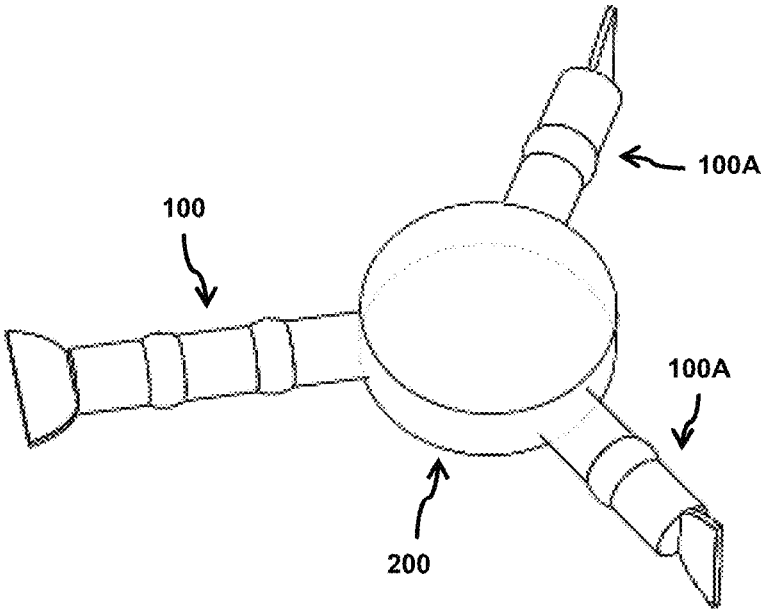
FIG. 28 is a simplified conceptual drawing of another bionic robot with three tail structures in accordance with certain embodiments of the present disclosure.

FIG. 27 illustrates the preferred configuration of the bionic robot 10 with three tail structures 100 evenly distributed around the head 200. This configuration can achieve a variety of motions with better stability, mobility, agility, and loading capability in a diverse water flow environment. FIG. 28 is an alternative configuration of the bionic robot 10 with two short tail structures 100A and one tail structure 100 with three joint structures 110. A different number of joint structures 110 can be configured for different propulsion power and efficiency.

Figure 29:
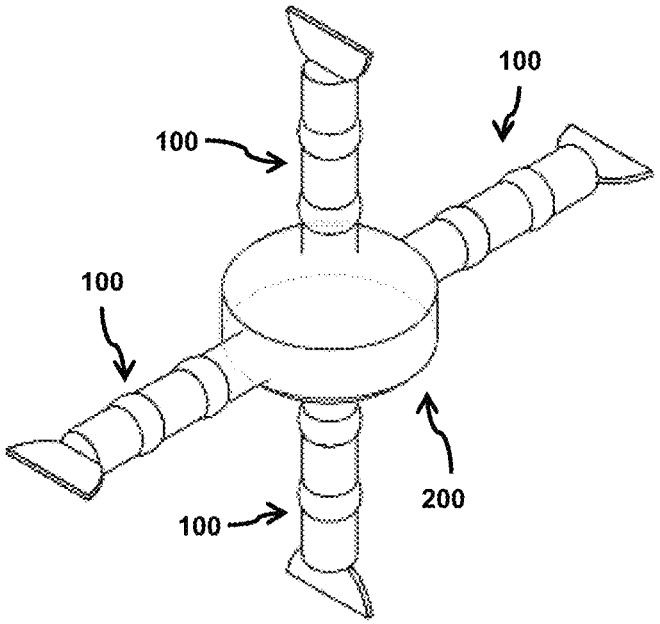
FIG. 29 is a simplified conceptual drawing of the bionic robot with four tail structures in accordance with certain embodiments of the present disclosure.
Figure 30:
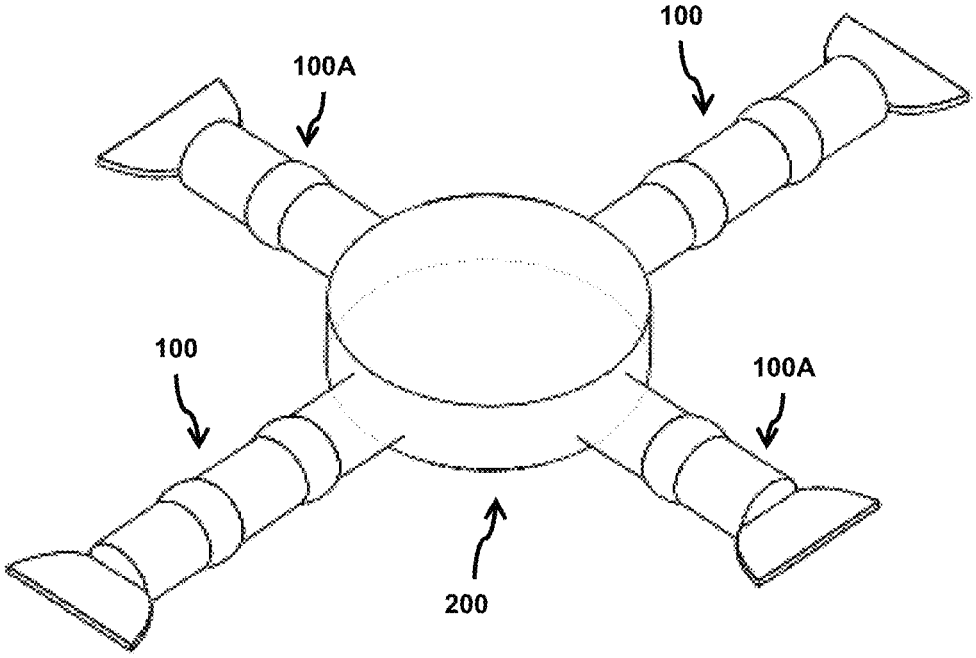
FIG. 30 is a simplified conceptual drawing of another bionic robot with four tail structures in accordance with certain embodiments of the present disclosure.
Figure 31:
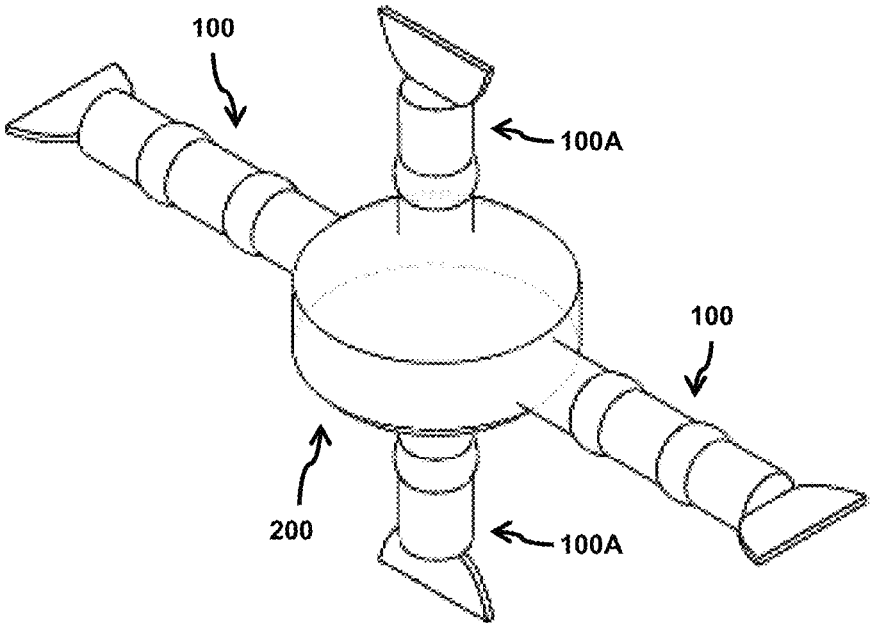
FIG. 31 is a simplified conceptual drawing of yet another bionic robot with four tail structures in accordance with certain embodiments of the present disclosure.

FIGS. 29-31 illustrate different configurations of the bionic robot 10 with four tail structures 100. The different positions and lengths of the tail structure 100 can provide thrust in multiple directions of space, which can optimize the bionic robot 10 for particular applications.

Figure 32:
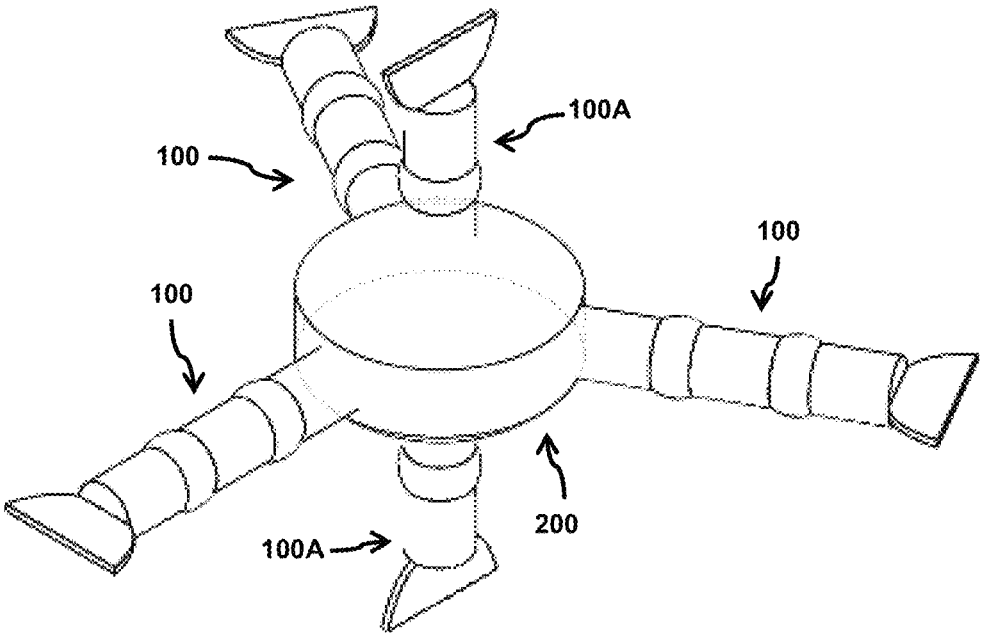
FIG. 32 is a simplified conceptual drawing of the bionic robot with five tail structures in accordance with certain embodiments of the present disclosure.
Figure 33:
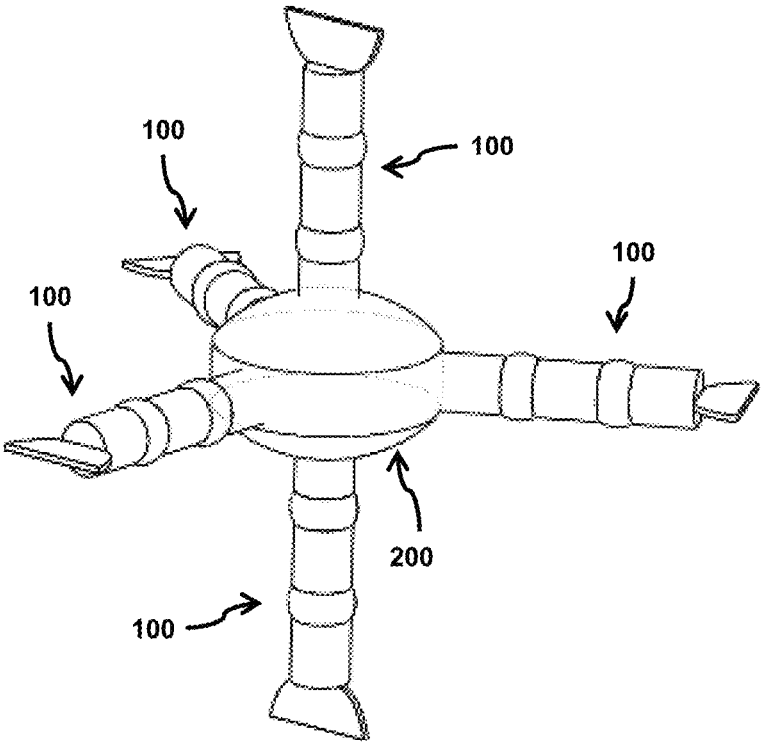
FIG. 33 is a simplified conceptual drawing of another bionic robot with five tail structures in accordance with certain embodiments of the present disclosure.

There are two conceptual drawings for the bionic robot 10 with four tail structures 100, as shown in FIGS. 32-33. The increased number of tail structures 100 can provide multiple locomotion modes, such as using three tail structures 100 to maintain movement direction and balance, and two tail structures 100 for grabbing the target. Alternatively, the three tail structures 100 can be used to perform in-situ rotation along one direction, while the other two tail structures 100 can move the bionic robot 10 forward or background.

Therefore, the bionic robot 10 of the present disclosure can mimic the movement patterns of a wide variety of marine life, for example, tuna, snake, turtle, shark, manta ray, etc. This combined structure, as described above, allows for omnidirectional motion movements without the need for turns in the water. In the flowing environment, the multiple tail structures 100 can achieve stronger stability, mobility, agility, and loading capability. This illustrates the fundamental structure of a bionic underwater robot in accordance with the present disclosure. It will be apparent that variants of the above-disclosed and other features and functions, or alternatives thereof, may be combined into many other different methods or apparatuses. The present embodiment is, therefore, to be considered in all respects as illustrative and not restrictive. The scope of the disclosure is indicated by the appended claims rather than by the preceding description, and all changes that come within the meaning and range of equivalency of the claims are therefore intended to be embraced therein.

What is claimed is:

1. A bionic robot for underwater use, comprising:
a head; and
one or more tail structures,
wherein:
each of the one or more tail structures comprises one or more joint structures;
each of the one or more joint structures comprises a connection plate, and a modular assembly motorized for performing various movement motions of the joint structure; and
the modular assembly comprises an upper servo motor, a lower servo motor, and a bevel gear mechanism.

2. The bionic robot of claim 1, wherein the bevel gear mechanism is integrally formed by an intermediate bevel gear, a first bevel gear, and a second bevel gear, wherein:
the upper servo motor drives the first bevel gear from a first side of the modular assembly; and
the lower servo motor drives the second bevel gear from a second side of the modular assembly.

3. The bionic robot of claim 2, wherein the connection plate is fixedly attached to or screwed to the intermediate bevel gear for achieving a yaw motion or a pitch motion of the joint structure.

4. The bionic robot of claim 2, wherein:
the upper servo motor drives an upper motor gear coupled to a first reduction gear via a first middle gear;
the lower servo motor drives a lower motor gear coupled to a second reduction gear via a second middle gear;
the first reduction gear and the first bevel gear are fixed; and
the second reduction gear and the second bevel gear are fixed.

5. The bionic robot of claim 4, wherein:
the first reduction gear has a larger number of teeth than the first middle gear; and
the second reduction gear has a larger number of teeth than the second middle gear.

6. The bionic robot of claim 1, wherein each tail structure comprises a fin structure fixed to an end plate sealed at a longitudinal distal end of the tail structure.

7. The bionic robot of claim 6, wherein the fin structure is a bionic fishtail with an emarginate caudal fin shape.

8. The bionic robot of claim 1, wherein the joint structure is mechanically sealed within a silicone tube and a skeleton, thereby the modular assembly is sealed inside the joint structure.

9. The bionic robot of claim 8, wherein the silicone tube is clamped to the skeleton using a clamp and silicone glue to prevent water seepage.

10. The bionic robot of claim 1, wherein the head comprises one or more tail drive assemblies for controlling movement of the one or more tail structure.

11. The bionic robot of claim 10, wherein the tail drive assembly comprises a head servo motor, a motor pinion, a spur gear, a motor shaft, and a rotary shaft, wherein the motor shaft is fixed to the motor pinion for driving the spur gear and the rotary shaft.

12. The bionic robot of claim 11, wherein the motor pinion has a smaller number of teeth than the spur gear for reducing the rotational speed of the rotary shaft.

13. The bionic robot of claim 11, wherein the rotary shaft is connected to the tail structure for driving the tail structure with a sealing effect from an external water environment.

14. The bionic robot of claim 1, wherein the head comprises three sealed connectors for connecting to an underwater acoustic transceiver or other accessory devices, wherein the underwater acoustic transceiver is configured to communicate based on an underwater acoustic network.

15. The bionic robot of claim 1, wherein the head comprises a plurality of infrared sensors.

16. The bionic robot of claim 1, wherein the head comprises one or more pressure sensors.

17. The bionic robot of claim 1, wherein the modular assembly is cable driven, or hydraulic driven.

18. A bionic robot for underwater use, comprising:
a head; and
three tail structures,
wherein:
each of the three tail structures comprises one or more joint structures;
each of the one or more joint structures comprises a connection plate, and a modular assembly motorized for performing various movement motions of the joint structure; and
the modular assembly comprises an upper servo motor, a lower servo motor, and a bevel gear mechanism.

19. The bionic robot of claim 18, wherein one of the three tail structures comprises three joint structures, and each of the other two tail structures comprises two joint structures.

20. The bionic robot of claim 18, wherein one of the three tail structures comprises two joint structures, and each of the other two tail structures comprises three joint structures.

* * * * *